US012644454B2

(12) United States Patent
Lee et al.

(10) Patent No.: US 12,644,454 B2
(45) Date of Patent: Jun. 2, 2026

(54) SCROLL COMPRESSOR INCLUDING BACK PRESSURE COMMUNICATION UNIT

(71) Applicant: LG ELECTRONICS INC., Seoul (KR)

(72) Inventors: Jaeha Lee, Seoul (KR); Sungyong Ahn, Seoul (KR); Taekyoung Kim, Seoul (KR); Seheon Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/854,660

(22) PCT Filed: Jul. 25, 2022

(86) PCT No.: PCT/KR2022/010896
§ 371 (c)(1),
(2) Date: Oct. 7, 2024

(87) PCT Pub. No.: WO2023/204354
PCT Pub. Date: Oct. 26, 2023

(65) Prior Publication Data

US 2025/0354553 A1 Nov. 20, 2025

(30) Foreign Application Priority Data

Apr. 20, 2022 (KR) ..... 10-2022-0049012

(51) Int. Cl.
*F04C 18/02* (2006.01)
*F04C 23/00* (2006.01)
(Continued)

(52) U.S. Cl.
CPC ..... *F04C 18/0215* (2013.01); *F04C 23/001* (2013.01); *F04C 23/02* (2013.01);
(Continued)

(58) Field of Classification Search
CPC ..... F04C 23/001; F04C 23/003; F04C 23/02; F04C 18/0215–0292; F04C 11/001; F04C 11/003; F04C 2/025
See application file for complete search history.

(56) References Cited

U.S. PATENT DOCUMENTS

2006/0204378 A1 9/2006 Anderson
2020/0370557 A1* 11/2020 Moon ..... F04C 18/0215

FOREIGN PATENT DOCUMENTS

CN 107654373 A * 2/2018 ..... F04C 18/0223
CN 116085258 A * 5/2023 ..... F04C 23/02
(Continued)

OTHER PUBLICATIONS

International Search Report (with English Translation) and Written Opinion dated Jul. 19, 2023 issued in Application No. PCT/KR2022/010896.

*Primary Examiner* — Laert Dounis
(74) *Attorney, Agent, or Firm* — KED & ASSOCIATES

(57) ABSTRACT

A scroll compressor is provided. The scroll compressor comprises a main frame provided between a first compression unit and a second compression unit, and the main frame may comprise at least one back pressure communication unit communicating between a first back pressure chamber and a second back pressure chamber. Accordingly, even if the back pressure of the first back pressure chamber and/or the second back pressure chamber rises above a set pressure when the compressor is started, the pressure in a back pressure chamber with a relatively high back pressure is transferred to a back pressure chamber with a relatively low back pressure, thereby enabling both back pressure chambers to quickly recover an appropriate level of back pressure while suppressing friction loss and dissipation in the compression
(Continued)

unit, and at the same time suppressing leakage between compression chambers to increase compression efficiency.

17 Claims, 14 Drawing Sheets

(51) Int. Cl.
*F04C 23/02* (2006.01)
*F04C 27/00* (2006.01)
*F04C 29/12* (2006.01)

(52) U.S. Cl.
CPC ..... *F04C 27/00* (2013.01); *F04C 29/12* (2013.01); *F04C 2240/30* (2013.01)

(56) References Cited

FOREIGN PATENT DOCUMENTS

| | | | | | |
|---|---|---|---|---|---|
| DE | 112017001535 | T5 | * | 12/2018 | ..... F04C 18/02 |
| JP | 2011-214505 | | | 10/2011 | |
| JP | 2011214505 | A | * | 10/2011 | |
| JP | 2018025124 | A | * | 2/2018 | ..... F04C 18/344 |
| KR | 20080038733 | A | * | 5/2008 | ..... F04C 29/0021 |
| KR | 10-2015-0006278 | | | 1/2015 | |
| KR | 20150006278 | A | * | 1/2015 | ..... F04C 23/008 |

* cited by examiner

SCROLL COMPRESSOR INCLUDING BACK PRESSURE COMMUNICATION UNIT

CROSS-REFERENCE TO RELATED PATENT APPLICATIONS

This application is a U.S. National Stage Application under 35 U.S.C. § 371 of PCT Application No. PCT/KR2022/010896, filed Jul. 25, 2022, which claims priority to Korean Patent Application No. 10-2022-0049012, filed Apr. 20, 2022, whose entire disclosures are hereby incorporated by reference.

TECHNICAL FIELD

The present disclosure relates to a scroll compressor, and more particularly, to a twin scroll compressor.

BACKGROUND ART

In a scroll compressor, a fixed scroll (or non-orbiting scroll) and an orbiting scroll that configure a compression unit are engaged with each other to define a pair of compression chambers. This scroll compressor has fewer components and can rotate at high speed because suction, compression, and discharge occur continuously while the orbiting scroll rotates. Additionally, since a torque required for compression is less changed and suction and compression occur continuously, noise and vibration are low. For this reason, the scroll compressors are widely applied to air conditioners.

Scroll compressors may be classified into single scroll compressors and twin scroll compressors depending on the number of compression units. Single scroll compressor have one compression unit, and twin scroll compressors have a plurality of compression units.

Patent Document 1 (U.S. Patent Publication No. 2006/0204378 A1) discloses a method such that a drive motor is provided in a middle portion, and a first compression unit and a second compression unit are disposed at both ends of a rotating shaft coupled to a rotor of the drive motor, respectively. According to Patent Document 1, as both of the compression units are spaced apart from each other, it may be difficult to share parts. Thus, a manufacture cost may be increased and a size of the compressor may be increased.

The scroll compressor in the related art as described above is configured such that the first compression unit and the second compression unit are apart from each other with a drive motor therebetween. Thus, when an abnormal operation occurs in any of both the compression units, it may be difficult to quickly and easily resolve this abnormal operation and a manufacture cost resulting therefrom may increase. For example, when a pressure in a back pressure chamber in which an orbiting scroll is supported toward a fixed scroll is increased excessively, and thus, the orbiting scroll comes into excessive contact with and the fixed scroll, a valve needs to be provided in both compression units to resolve this. Therefore, an operation for resolving overpressure may be delayed, and a manufacture cost may be increased.

DISCLOSURE OF INVENTION

Technical Problem

One aspect of the present disclosure is to provide a scroll compressor configured as a twin scroll compressor capable of quickly and easily resolving an abnormal operation in compression units at both sides.

The present disclosure also describes a scroll compressor configured as a twin scroll compressor capable of quickly resolving an excessive increase in a back pressure of any or all of compression units at both sides.

The present disclosure further describes a scroll compressor configured as a twin scroll compressor capable of maintaining a proper back pressure in compression chambers at both sides by allowing the compression units at both sides to communicate with each other while suppressing unnecessary movement of oil between the compression chambers at both sides.

Another aspect of the present disclosure is to provide a scroll compressor configured as a twin scroll compressor capable of quickly and easily resolving an abnormal operation while reducing a manufacture cost.

The present disclosure also describes a scroll compressor configured as a twin scroll compressor such that a structure in which compression chambers at both sides communicate with each other may be simplified.

The present disclosure further describes a scroll compressor configured as a twin scroll compressor such that a structure in which compression chambers at both sides communicate with each other may be simplified and operational reliability may be enhanced.

Solution to Problem

In order to achieve those aspects and other advantages of the present disclosure, there is provided a scroll compressor including a casing, a drive motor, a rotating shaft, a first compression unit, a second compression unit, a main frame, a first compression chamber, and a second compression chamber. The drive motor may be disposed inside the casing. The rotating shaft may be coupled to a rotor of the drive motor and include a first eccentric portion and a second eccentric portion spaced apart from each other in an axial direction. The first compression unit may have a first orbiting scroll coupled to the first eccentric portion of the rotating shaft to perform an orbiting motion, and a first fixed scroll engaged with the first orbiting scroll to define a first compression chamber. The second compression unit may have a second orbiting scroll coupled to the second eccentric portion of the rotating shaft to perform an orbiting motion, and a second fixed scroll engaged with the second orbiting scroll to define a second compression chamber. The main frame may have a shaft accommodation portion disposed therein such that the rotating shaft penetrates through the shaft accommodation portion, and be located between the first compression unit and the second compression unit. The first back pressure chamber may be disposed between the first orbiting scroll and a first side surface of the main frame to support the first orbiting scroll toward the first fixed scroll. The second back pressure chamber may be disposed between the second orbiting scroll and a second side surface of the main frame to support the second orbiting scroll toward the second fixed scroll. The main frame may include at least one back pressure communication unit configured to communicate between the first back pressure chamber and the second back pressure chamber. Accordingly, even when a back pressure of the first back pressure chamber and/or the second back pressure chamber rises to a set pressure or higher when the compressor is started, a pressure in a back pressure chamber with a relatively high back pressure may be transferred to a back pressure chamber with a relatively low back pressure, thereby enabling back pressure chambers at both sides to quickly recover an appropriate level of back pressure while suppressing friction loss and dissipation in the compression unit, and at the same time suppressing leakage between compression chambers to increase compression efficiency.

As one example, a first back pressure sealing member may be disposed between the first orbiting scroll and the first side surface of the main frame, the first side surface facing the first orbiting scroll, and configured to divide the first back pressure chamber into a first inner back pressure chamber and a first outer back pressure chamber. A second back pressure sealing member may be disposed between the second orbiting scroll and the second side surface of the main frame, the second side surface facing the second orbiting scroll, and configured to divide the second back pressure chamber into a second inner back pressure chamber and a second outer back pressure chamber. The back pressure communication unit may penetrate between the first outer back pressure chamber and the second outer back pressure chamber. Thus, a structure of the back pressure communication unit may be simplified to suppress an increase in a manufacture cost and operational reliability of the back pressure communication unit may be enhanced As another example, a first Oldham ring accommodation portion into which a first Oldham ring is inserted may be disposed on the first side surface of the main frame to have an annular shape, and a second Oldham ring accommodation portion into which a second Oldham ring is inserted may be disposed on the second side surface of the main frame to have an annular shape. The back pressure communication unit may penetrate between the first Oldham ring accommodation portion and the second Oldham ring accommodation portion. Thus, not only a length of the back pressure communication hole may be minimized to be easily machined, but also oil may quickly and smoothly move between both the back pressure chambers to quickly decrease a pressure in a corresponding back pressure chamber.

As another example, the back pressure communication unit may be configured as a back pressure communicating hole having a single inner diameter. By doing so, the back pressure communicating hole may be easily configured.

As still another example, the back pressure communication unit may be configured as a back pressure communicating hole having a plurality of inner diameters. Thus, the inner diameters of the back pressure communication holes may be configured to be small, but easily machined.

In detail, the back pressure communicating hole may be configured as a plurality of communication holes having different inner diameters, and a communication hole with a great inner diameter, among the plurality of communication holes, may be configured to have a length greater than a length of a communication hole with a small inner diameter. Thus, the inner diameters of the back pressure communication holes may be configured to be small and long, but easily machined.

In detail, the second back pressure chamber may be positioned closer to the drive motor than the first back pressure chamber. The back pressure communicating hole may be configured such that an end portion toward the second back pressure chamber has a second diameter smaller than a first diameter of an end portion toward the first back pressure chamber. Thus, during a normal operation of a bottom-compression type scroll compressor in which a drive motor is placed at an upper side than compression units, oil in the compression unit located at an upper side may be suppressed from being leaked toward a compression unit located at a lower side due to a weight of the oil.

As still another example, the back pressure communication unit may include a back pressure communication hole configured to communicate between the first back pressure chamber and the second back pressure chamber, and a pin member inserted into the back pressure communication hole. A sectional area of the pin member may be disposed to be smaller than a sectional area of the back pressure communication hole. By doing so, the back pressure communication hole may be configured to have a large inner diameter, while a substantial back pressure passage may be configured to be small, and thus, the back pressure communication unit is easily configured.

In detail, a support end configured to support the pin member in an axial direction may be disposed at one end of the back pressure communication hole. Thus, the pin member may be securely fixed into the back pressure communication hole, thereby enhancing reliability.

In detail, a communication groove may be disposed in an outer circumferential surface of the pin member, and the communication groove may be disposed to traverse between both longitudinal ends of the pin member. Thus, the back pressure communication hole may be configured to have a large inner diameter, while a substantial back pressure passage may be configured to be small to thereby easily configure the back pressure communication unit.

As another example, the back pressure communication unit may include a back pressure communication hole configured to communicate between the first back pressure chamber and the second back pressure chamber, and a valve member configured to open or close the back pressure communication hole. By doing so, in a case of abnormal operation of the compressor, back pressures in back pressure chambers at both sides may be properly maintained using one valve, and during a normal operation of the compressor, the back pressure communication hole may be mechanically blocked. Thus, the back pressure communication hole may be configured to have a large inner diameter, while oil in a back pressure chamber located at an upper side may be suppressed from being leaked into a back pressure chamber located at a lower side.

In detail, a valve accommodating hole may be further disposed in the main frame in a direction intersecting with the back pressure communication hole. The valve member may be slidably inserted into the valve accommodating hole to open or close the back pressure communication hole. Thus, the valve member configured to open or close the back pressure communication hole may be easily installed.

In detail, the valve member may be supported in a direction toward the back pressure communication hole by an elastic member disposed at a side opposite to the back pressure communication hole. Thus, the valve member configured to open or close the back pressure communication hole may quickly block the back pressure communication hole during a normal operation to thereby increase operational reliability.

As still another example, the first eccentric portion and the second eccentric portion may be disposed such that a center of the first eccentric portion and a center of the second eccentric portion are configured to be positioned at different rotational angles in an axial direction. Accordingly, eccentric loads due to centrifugal force of the first orbiting scroll coupled to the first eccentric portion and centrifugal force of the second orbiting scroll coupled to the second eccentric portion may offset each other, thereby reducing compressor vibration.

Advantageous Effects of Invention

In accordance with the detailed description, a scroll compressor may include a main frame disposed between a first compression unit and a second compression unit, and the main frame may include at least one back pressure communication unit communicating between a first back pressure chamber and a second back pressure chamber. Accordingly, even when a back pressure of the first back pressure chamber and/or the second back pressure chamber rises to a set pressure or higher when the compressor is started, a pressure in a back pressure chamber with a relatively high back pressure may be transferred to a back pressure chamber with a relatively low back pressure, thereby enabling back pressure chambers at both sides to quickly recover an appropriate back pressure while suppressing friction loss and dissipation in the compression unit, and at the same time suppressing leakage between the compression chambers to increase compression efficiency.

In accordance with the detailed description, the scroll compressor may be configured such that a back pressure communication unit which communicates between back pressure chambers at both sides may be disposed to penetrate through a space between a first outer back pressure chamber and a second outer back pressure chamber. By doing so, a structure of the back pressure communication unit may be simplified, thereby suppressing an increase in a manufacture cost, as well as enhancing operational reliability of the back pressure communication unit.

In accordance with the detailed description, the scroll compressor may be configured such that a back pressure communication unit in communication between back pressure chambers at both sides may be disposed to penetrate between a first Oldham ring accommodation portion disposed on a first side surface of a main frame and a second Oldham ring accommodation portion disposed on a second side surface of the main frame. Accordingly, not only a length of the back pressure communication hole may be minimized to be easily machined, but also oil may quickly and smoothly move between the back pressure chambers at both sides to quickly decrease a pressure in a corresponding back pressure chamber.

In accordance with the detailed description, the scroll compressor may be configured such that a back pressure communication unit is configured as a back pressure communication hole having a single inner diameter. By doing so, the back pressure communication hole may be easily configured.

In accordance with the detailed description, the scroll compressor may be configured such that a back pressure communication unit may be configured as a back pressure communication hole having a plurality of inner diameters. By doing so, an inner diameter of the back pressure communication hole may be configured to be small, but easily machined.

In accordance with the detailed description, the scroll compressor may be configured such that a back pressure communication unit includes a back pressure communication hole which communicates between a first back pressure chamber and a second back pressure chamber, and a pin member inserted into the back pressure communication hole. Thus, the back pressure communication hole may be configured to have a large inner diameter, while a substantial back pressure passage may be configured to be small, and thus, the back pressure communication unit is easily configured.

In accordance with the detailed description, the scroll compressor may be configured such that a back pressure communication unit includes a back pressure communication hole in communication between the first back pressure chamber and the second back pressure chamber, and a valve member configured to open or close the back pressure communication hole. By doing so, in a case of abnormal operation of the compressor, back pressures in back pressure chambers at both sides may be properly maintained using one valve, and during a normal operation, the back pressure communication hole may be mechanically blocked. Thus, the back pressure communication hole may be configured to have a large inner diameter, and oil in a back pressure chamber located at an upper side may be suppressed from being leaked into a back pressure chamber located at a lower side.

BRIEF DESCRIPTION OF DRAWINGS

FIG. 5 shows a state of a normal operation. FIG. 6 shows a state of an abnormal operation.

FIG. 13 shows a state of a normal operation. FIG. 14 shows a state of an abnormal operation.

MODE FOR THE INVENTION

Description will now be given in detail of a scroll compressor disclosed herein, with reference to the accompanying drawings. In the following description, a description of some components may be omitted to clarify features of the present disclosure.

In addition, the term "upper side" used in the following description refers to a direction away from a support surface for supporting a scroll compressor according to an implementation of the present disclosure, that is, a direction toward a driving unit (motor part or drive motor) when viewed based on the driving unit (motor part or drive motor) and a compression unit. The term "lower side" refers to a direction toward the support surface, that is, a direction toward the compression unit when viewed based on the driving unit (motor part or drive motor) and the compression unit.

The term "axial direction" used in the following description refers to a lengthwise (longitudinal) direction of a rotating shaft. The "axial direction" may be understood as an up and down (or vertical) direction. The term "radial direction" refers to a direction that intersects the rotating shaft.

In addition, in the following description, a hermetic scroll compressor in which a driving unit (motor unit or drive motor) and a compression unit are disposed in a casing will be described as an example. However, the present disclosure may be applied equally to an open type compressor in which a driving unit (motor unit or drive motor) is disposed outside a casing and connected to a compression unit disposed inside the casing.

In addition, a description will be given of a bottom-compression type scroll compressor in which a driving unit (a motor unit or a drive motor) and a compression unit are disposed vertically in an axial direction and a compression unit is located below the motor unit. However, the present disclosure may be applied equally to a horizontal scroll compressor in which a driving unit (motor unit or drive motor) and a compression unit are disposed in left and right directions, as well as a top-compression type scroll compressor in which the compression unit is located above the driving unit (motor unit or drive motor).

In addition, hereinafter, a twin scroll compressor in which two compression units are disposed in an axial direction is described as an example. However, this may be identically applied to a single scroll compressor having one compression unit.

Figure 1:
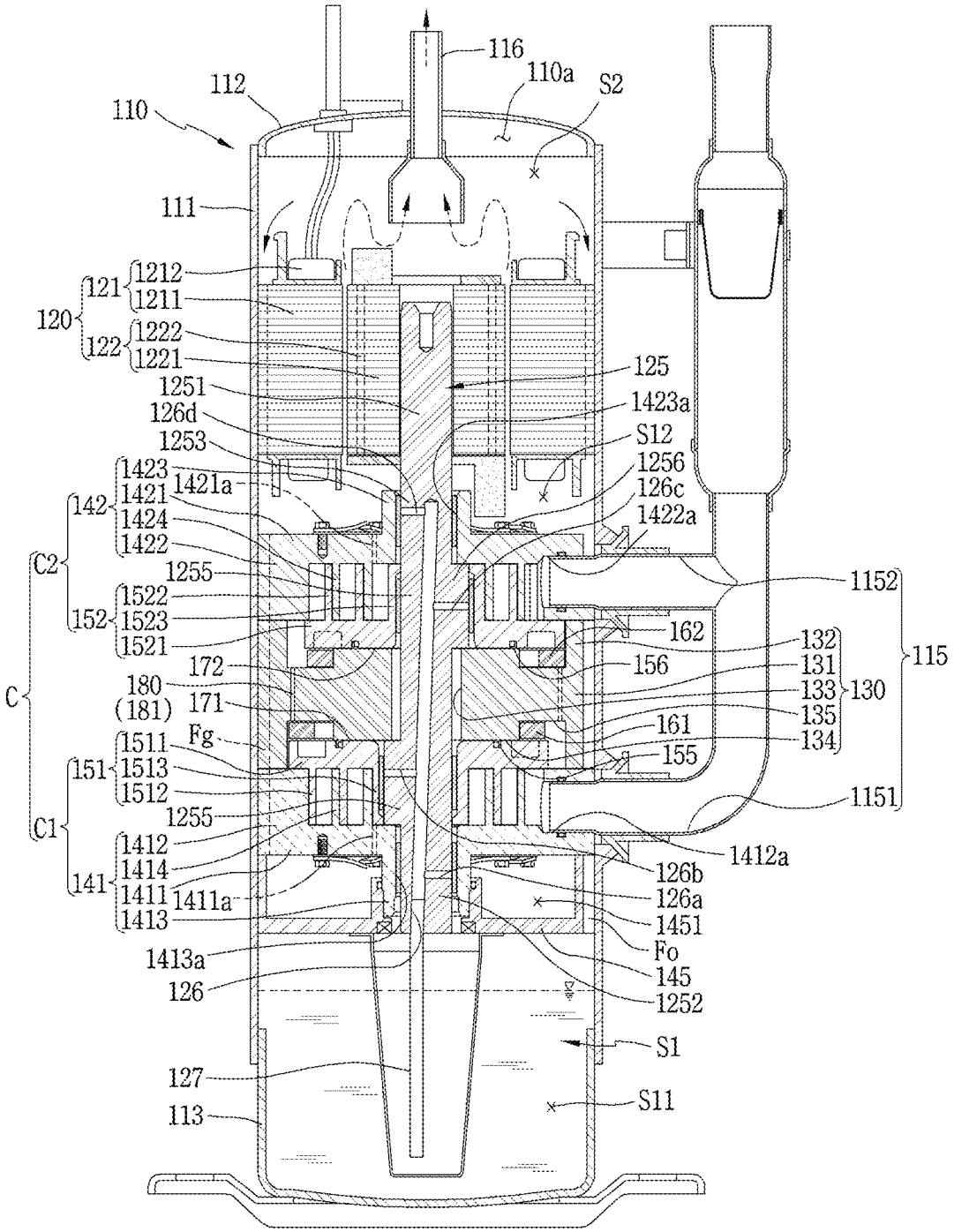
FIG. 1 is a longitudinal view of a scroll compressor according to the present embodiment.
Figure 2:
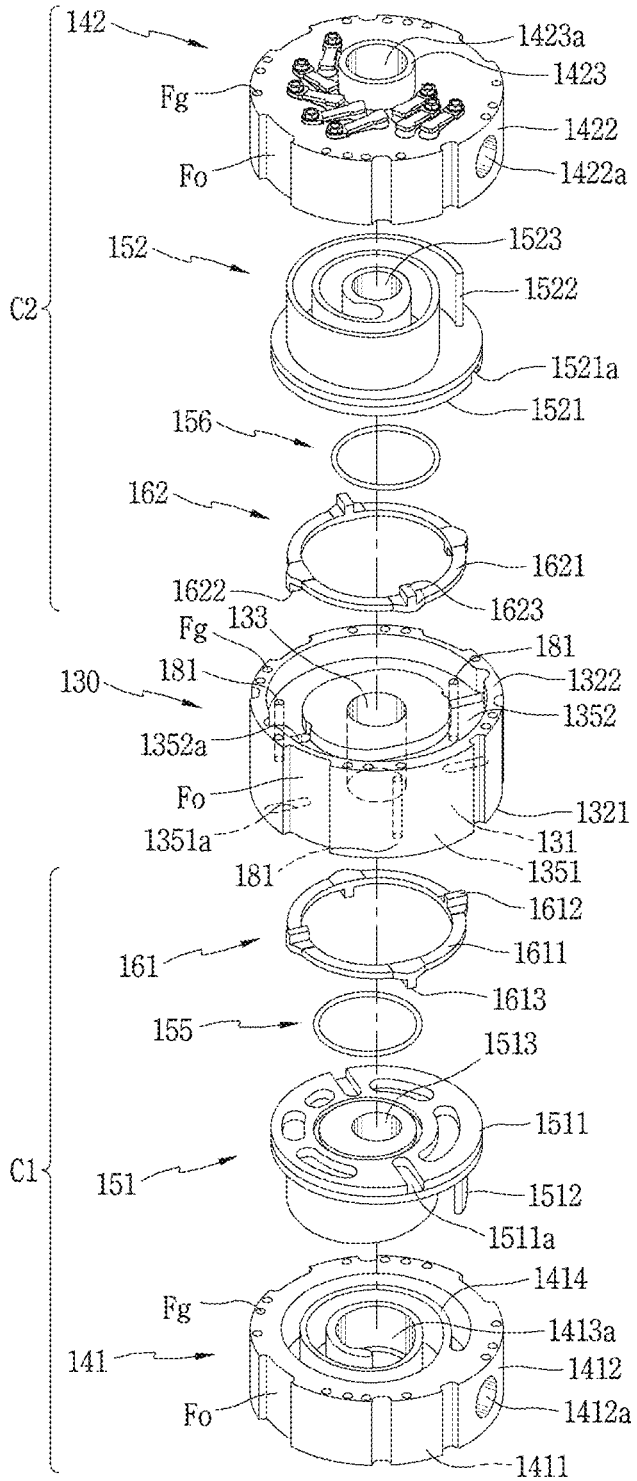
FIG. 2 is an exploded perspective view illustrating a compression unit of FIG. 1.

FIG. 1 is a longitudinal sectional view illustrating a scroll compressor according to the present embodiment. FIG. 2 is an exploded perspective view illustrating a compression unit of FIG. 1.

Referring to FIG. 1, a twin scroll compressor (hereinafter, briefly referred to as a scroll compressor) according to the present embodiment includes a drive motor 120 constituting a motor part and installed in an upper-half portion of a casing 110, and a first compression unit C1 and a second compression unit C2 each disposed at one side of the drive motor 120.

The drive motor 120 constituting the motor part is coupled to an upper end of a rotating shaft 125 to be described later, and the first compression unit C1 and the second compression unit C2 are sequentially coupled to a lower end of the rotating shaft 125. Accordingly, the scroll compressor has a bottom-compression type structure as described above, and the first compression unit C1 and the second compression unit C2 are coupled to the drive motor 120 by one rotating shaft 125 to operate at a same speed.

Referring to FIG. 1, the casing 110 according to an embodiment of the present disclosure may include a cylindrical shell 111, an upper shell 112, and a lower shell 113. The cylindrical shell 111 may be configured in a cylindrical shape with upper and lower ends open. The upper shell 112 may be coupled to cover the open upper end of the cylindrical shell 111. The lower shell 113 may be coupled to cover the open lower end of the cylindrical shell 111. Accordingly, an inner space 110*a* of the casing 110 may be sealed, and the sealed inner space 110*a* of the casing 110 may be divided into a lower space S1 and an upper space S2 based on the drive motor 120.

The lower space S1 may be a space defined below the drive motor 120. The lower space S1 may be further divided into an oil storage space S11 and an outflow passage S12 with respect to a compression unit C including the first compression unit C1 and the second compression unit C2.

The oil storage space S11 may be a space defined below the compression unit C to store oil or mixed oil in which liquid refrigerant is mixed. The outflow passage S12 may be a space defined between an upper surface of the compression unit C and a lower surface of the drive motor 120. Refrigerant compressed in the compression unit C or mixed refrigerant in which oil is contained may be discharged into the outflow passage S12.

The upper space S2 may be a space defined above the drive motor 120 to constitute an oil-separating space in which oil is separated from refrigerant discharged from the compression unit C. A refrigerant discharge pipe 116 communicates with the upper space S2.

The lower space S1 and the upper space S2 may communicate with each other through an inner passage penetrating through the inner space 110*a* of the casing 110, or through an external passage passing through outside of the casing 110. In the present embodiment, an example in which the lower space S1 and the upper space S2 of the casing 110 communicate with each other through an inner passage. For example, the lower space S1 and the upper space S2 of the casing 110 may communicate with each other through an internal passage sequentially penetrating between an inner circumferential surface of the casing 110 and an outer circumferential surface of the drive motor 120 and between an inner circumferential surface of the casing 110 and an outer circumferential surface of the compression unit C. The inner passage may be divided into a refrigerant discharge passage Fg and an oil return passage Fo. Accordingly, a refrigerant discharged into the lower space S1 may move to the upper space S2 through the refrigerant discharge passage Fg. Then, oil separated from the refrigerant in the upper space S2 may be returned to the lower space S1 through the oil return passage Fo. Since this is known in the field of the bottom-compression type scroll compressor, a detailed description thereof is not provided here.

A refrigerant suction pipe 115 is coupled through a side surface of the cylindrical shell 111. Accordingly, the refrigerant suction pipe 115 is coupled through the cylindrical shell 111 constituting the casing 110 in a radial direction.

The refrigerant suction pipe 115 may be configured in an F shape having one inlet and two outlets. For example, one end of the refrigerant suction pipe 115 defining the inlet is connected to a refrigerant pipe (not shown) extending from an evaporator (not shown), and another end of the refrigerant suction pipe 115 defining the outlets is divided into a first suction pipe 1151 and a second suction pipe 1152, and the first suction pipe 1151 is connected to a first suction port 1412*a* to be described later, and the second suction pipe 1152 is connected to a second suction port 1422*a* to be described later. Accordingly, the refrigerant is directly sucked into a first compression chamber V1 and a second compression chamber V2 through the first suction pipe 1151 and the second suction pipe 1152, respectively.

An inner end of the refrigerant discharge pipe 116 is coupled through an upper portion of the upper shell 112 to communicate with the inner space 110*a* of the casing 110, specifically, the upper space S2 disposed above the drive motor 120.

One end portion of an oil circulation pipe (not illustrated) may be coupled through a lower-half portion of the lower shell 113 in a radial direction. Both ends of the oil circulation pipe may be open, and another end portion of the oil circulation pipe may be coupled through the refrigerant suction pipe 115. An oil circulation valve (not illustrated) may be installed in a middle portion of the oil circulation pipe.

Referring to FIG. 1, the drive motor 120 according to the embodiment includes a stator 121 and a rotor 122. The stator 121 is inserted to fit into the inner circumferential surface of the cylindrical shell 111, and the rotor 122 is rotatably disposed in the stator 121.

The stator 121 includes a stator core 1211 and a stator coil 1212.

The stator core 1211 is disposed in an annular shape or a hollow cylindrical shape and is shrink-fit to the inner circumferential surface of the cylindrical shell 111. An outer circumferential surface of the stator core 1211 may be cut or recessed in a D-cut shape along an axial direction so that oil separated in the upper space S1 may be returned to the oil storage space S11.

The stator coil 1212 may be wound around the stator core 1211 and may be electrically connected to an external power source through a power cable 1141 coupled through the casing 110. A refrigerant passage (not shown) is disposed between the stator core 1211 and the stator coil 1212 so that a refrigerant discharged from the first compression unit C1 moves into the upper space S2.

The rotor 122 includes a rotor core 1221 and permanent magnets 1222.

The rotor core 1221 is disposed in a cylindrical shape, and is rotatably accommodated in a central portion of the stator core 1211 to have a preset gap. Accordingly, the gap between the stator core 1211 and the rotor core 1221 defines a refrigerant passage (not shown).

The permanent magnets 1222 are buried along an edge of the rotor core 1221, and an upper end portion of the rotating shaft 125 is coupled to a center of the rotor core 1221. Accordingly, while rotating together with the rotor 122, the rotating shaft 125 transmits rotational force of the drive motor 120 to a first orbiting scroll 151 and a second orbiting scroll 152 both constituting the compression unit C.

The rotating shaft 125 includes a main shaft portion 1251, a first bearing portion 1252, a second bearing portion 1253, an extending portion 1254, a first eccentric portion 1255, and a second eccentric portion 1256. The first bearing portion 1252, the second bearing portion 1253, and a shaft alignment portion 1254 are disposed on a same axial line as that of the main shaft portion 1251, and the first eccentric portion 1255 and the second eccentric portion 1256 are disposed on an axial line different from that of the main shaft portion 1251. Accordingly, when the rotating shaft 125 rotates, the first eccentric portion 1255 and the second eccentric portion 1256 rotate eccentrically to an axial center O of the rotating shaft 125.

The main shaft portion 1251 defines an upper end portion of the rotating shaft 125 and is press-fit to be coupled to the rotor 122. The main shaft portion 1251 extends axially to be positioned on a same axial line as that of the rotor 122. Accordingly, the main shaft portion 1251 rotates concentrically with the rotor 122.

The first bearing portion 1252 is disposed between the main shaft portion 1251 and the first eccentric portion 1255, and the second bearing portion 1253 is disposed between the second eccentric portion 1256 and a lower end of the rotating shaft 125. Accordingly, the first bearing portion 1252 may be inserted into a first fixed scroll 141 to be described later and supported in a radial direction, and the second bearing portion 1253 may be inserted into a second fixed scroll 142 to be described later and supported in a radial direction.

The first eccentric portion 1255 and the second eccentric portion 1256 extend from the main shaft portion 1251 to constitute a lower-half portion of the rotating shaft 125, and are inserted and coupled into a compression unit. For example, the first eccentric portion 1255 is coupled to the first compression unit C1 to be described later, and the second eccentric port 1256 is coupled to the second compression unit C2 to be described later. Accordingly, the first eccentric portion 1255 and the second eccentric portion 1256 rotate together with the main shaft portion 1251 at a same speed.

The first eccentric portion 1255 and the second eccentric portion 1256 may be disposed on a same axial line or on a different axial line. In other words, the first eccentric portion 1255 and the second eccentric portion 1256 may be disposed eccentrically with a same eccentricity at a same rotational angle, or may be disposed eccentrically with different eccentricities at different rotational angles. In the present embodiment, the first eccentric portion 1255 and the second eccentric portion 1256 may be disposed on different axial lines. For example, the first eccentric portion 1255 and the second eccentric portion 1256 may be disposed with a phase difference of 180° to be diagonally symmetrical to each other with reference to the shaft alignment portion 1254. Accordingly, eccentric loads due to centrifugal force of the first orbiting scroll 151 coupled to the first eccentric portion 1255 and centrifugal force of the second orbiting scroll 152 coupled to the second eccentric portion 1256 may offset each other, thereby reducing compressor vibration.

In addition, an oil supply passage 126 is configured to have a hollow shape in the rotating shaft 125. The oil supply portion 126 may be disposed to penetrate through inside of the rotating shaft 125 or be grooved to a preset height. In the present embodiment, the oil supply portion 126 may be grooved from a lower end to an intermediate height of the rotating shaft 125, e.g., to the first bearing portion 1252. An oil pickup 127 configured to pump oil filled in the oil storage space S11 may be coupled to a lower end of the rotating shaft 125. Accordingly, during rotation of the rotating shaft 125, the oil filled in the oil storage space S11 is sucked into an upper end of the rotating shaft 125 through the oil pickup 127 and the oil supply passage 126 to lubricate a sliding portion.

The oil supply passage 126 may be disposed in an axial direction or disposed to be inclined at a preset angle. In the present embodiment, an example in which the oil supply passage 126 is disposed to be inclined is shown. Accordingly, oil pumped by the oil pickup 127 may be sucked due to centrifugal force in the oil supply passage 126 to be smoothly supplied to the portion.

Oil supply holes penetrating through an outer circumferential surface of the rotating shaft 125 are disposed in the oil supply passage 126. A plurality of oil supply holes may be arranged at a preset interval between a lower end and an upper end of the oil supply passage 126. For example, a first oil supply hole **126*a* may be disposed in the second bearing portion 1253, a second oil supply hole 126*b* may be disposed in the second eccentric portion 1256, a third oil supply hole 126*c* may be disposed in the first eccentric portion 1255, and a fourth oil supply hole 126*d* may be disposed in the first bearing portion 1252. Accordingly, the oil pumped by the oil supply passage 126** may be smoothly supplied to each bearing surface through each oil supply hole.

Referring to FIGS. 1 and 2, the compression unit C according to the present embodiment includes the first compression unit C1 and the second compression unit C2. The first compression unit C1 and the second compression unit C2 are disposed at both sides in an axial direction, respectively, to have the main frame 130 positioned therebetween. Accordingly, it may be understood that the main frame 130 is included in the compression unit C, but not in the first compression unit C1 and the second compression unit C2. Hereinafter, with reference to the main frame 130. a compression unit located at a lower side is defined as the first compression unit C1, and a compression unit located at an upper side is defined as the second compression unit C2.

The main frame 130 is configured in an annular shape to be fixedly coupled to an inner circumferential surface of the cylindrical shell 111. For example, the main frame 130 includes a frame end plate 131, a frame side wall 132, a shaft accommodation portion 133, a scroll support portion 134, and an Oldham ring accommodation portion 135.

The frame end plate 131 is a portion separating the first compression unit C1 from the second compression unit C2. The frame end plate 131 is fixed to an inner circumferential surface of the cylindrical shell 111 by performing shrink-fitting or welding. The shaft accommodation portion 133 having the rotating shaft 125 penetrating therethrough is disposed at a center of the frame end plate 131. The shaft accommodation portion 133 is configured to be greater than an outer diameter of the first eccentric portion 1255 so that the first eccentric portion 1255 of the rotating shaft 125 may pass through the shaft accommodation portion 133.

The frame side wall 132 is a portion in which the first fixed scroll 141 and the second fixed scroll 142 each to be described later are supported, and extends in a cylindrical shape to protrude from an edge of the frame end plate 131 along a circumferential direction by a preset height. Accordingly, the first fixed scroll 141 and the second fixed scroll 142 each supported on the frame side wall 132 may be provided with spaces into which the first orbiting scroll 151 and the second orbiting scroll 152 may be inserted, respectively, the spaces being defined between the first fixed scroll 141 and a first scroll support portion 1341 and between the second fixed scroll 142 and a second scroll support portion 1342, respectively. The first scroll support portion 1341 and the second scroll support portion 1342 will be described later.

The frame side wall 132 includes a first frame side wall 1321 and a second frame side wall 1322. The first frame side wall 1321 and the second frame side wall 1322 may be disposed symmetrically to each other. The first frame side wall 1321 extends from a first side surface (a lower surface) of the frame end plate 131 toward the first compression unit C1. The second frame side wall portion 1322 extends from a second side surface (an upper surface) of the frame end plate 131 toward the second compression unit C2. Accordingly, the first fixed scroll 141 to be described later may be supported on the first frame side wall 1321 in an axial direction, and the second fixed scroll 142 may be supported on the second frame side wall 1322 to be described later in an axial direction.

The shaft accommodation portion 133 is a portion through which the rotating shaft 125 penetrates, and may be disposed therethrough at a center of the frame end plate 131 in an axial direction. An inner diameter of the shaft accommodation portion 133 is configured to be greater than an outer diameter of the rotating shaft 125, more precisely, greater than an outer diameter of the first eccentric portion 1255 or the second eccentric portion 1256. Accordingly, the rotating shaft 125 including the first eccentric portion 1255 and the second eccentric portion 1256 may be coupled through the shaft accommodation portion 133.

The scroll support portion 134 is a portion in which the first orbiting scroll 151 and the second orbiting scroll 152 each to be described later are supported in an axial direction, and is disposed to be flat between the frame side wall 132 and the shaft accommodation portion 133. The scroll support portion 134 is disposed below the frame side wall 132 so that spaces capable of accommodating the first orbiting scroll 151 and the second orbiting scroll 152 are disposed between the first fixed scroll 141 and the second fixed scroll 142 each to be described later.

The scroll support portion 134 includes the first scroll support portion 1341 and the second scroll support portion 1342. The first scroll support portion 1341 and the second scroll support portion 1342 are disposed symmetrically to each other. Accordingly, the first orbiting scroll 151 to be described later is supported on the first scroll support portion 1341 in an axial direction, and the second orbiting scroll 152 to be described later may be supported on the second scroll support portion 1342 in an axial direction.

The Oldham ring accommodation portion 135 is a portion into which Oldham rings 161 and 162, i.e., anti-rotation mechanisms of the first and second orbiting scrolls 151 and 152 are rotatably inserted, and is disposed between an inner circumferential surface of the frame side wall 132 and an outer circumferential surface of the scroll support portion 134. Accordingly, the Oldham ring accommodation portion 135 may be configured as a groove positioned lower than the scroll support portion 134.

The Oldham ring accommodation portion 135 includes a first Oldham ring accommodation portion 1351 and a second Oldham ring accommodation portion 1352. The first Oldham ring accommodation portion 1351 and the second Oldham ring accommodation portion 1352 may be disposed symmetrically to each other. A first Oldham ring 161 to be described later is accommodated in the first Oldham ring accommodation portion 1351 to be coupled between a first side surface (a lower surface) of the main frame 130 and the first orbiting scroll 151, and a second Oldham ring 162 to be described later is accommodated in the second Oldham ring accommodation portion 1352 to be coupled between a second side surface (an upper surface) of the main frame 130 and the second orbiting scroll 152.

A first fixed key groove 1351*a* is disposed in the first Oldham ring accommodation portion 1351, and a second fixed key groove 1352*a* is disposed in the second Oldham ring accommodation portion 1352. A part of the first fixed key groove 1351*a* extends to an inner circumferential surface of the first frame side wall 1321, and a part of the second fixed key groove 1352*a* extends to an inner circumferential surface of the second frame side wall 1322.

A first fixed key 1612 of the first Oldham ring 161 to be described later is slidably inserted into the first fixed key groove 1351*a*, and a second fixed key 1622 of the second Oldham ring 162 to be described later is slidably inserted into the second fixed key groove 1352*a*. Accordingly, the first orbiting scroll 151 slides to perform an orbiting motion while being axially supported on the first scroll support portion 1341, and the second orbiting scroll 152 slides to perform an orbiting motion while being axially supported on the second scroll support portion 1342.

Referring to FIGS. 1 and 2, the first compression unit C1 according to the present embodiment is located below the main frame 130, and the first compression unit C1 includes the first fixed scroll 141 and the first orbiting scroll 151.

The first fixed scroll 141 may be fixed by being supported on the first side surface (the lower surface) of the main frame 130, precisely, on the first frame side wall 1321 in an axial direction. The first orbiting scroll 151 may be rotatably supported on the first scroll support portion 1341 in an axial direction on the first side surface of the main frame 130, precisely, in a first space between the first scroll support portion 1341 and the first fixed scroll 141 facing the first scroll support portion 1341. Accordingly, a pair of first compression chambers V1 are defined between the first fixed scroll 141 and the first orbiting scroll 151 both constituting the first compression unit C1.

The first fixed scroll 141 according to the present embodiment may include a first fixed end plate 1411, a first fixed side wall 1412, a first bearing protrusion 1413, and a first fixed wrap 1414.

The first fixed end plate 1411 is configured in a disc shape, and has a first bearing hole 1413*a* disposed through a center in an axial direction, the first bearing hole 1413*a* constituting the first bearing protrusion 1413 to be described later. The first bearing hole 1413*a* is disposed on a same axial line as that of the shaft accommodation portion 133 of the main frame 130. A bearing member configured as a bushing bearing, a ball bearing, or the like may be disposed on an inner circumferential surface of the first bearing hole 1413*a* to support the first bearing portion 1252 of the rotating shaft 125.

A first discharge port 1411*a* is disposed near the first bearing hole 1413*a*. The first discharge port 1411*a* is disposed to open toward a discharge space 1451 of a discharge cover 145 fixed to a second side surface (a lower surface) of the first fixed end plate 1411. Accordingly, refrigerant compressed in the first compression chambers V1 is discharged into the discharge space 1451 of the discharge cover 145 through the first discharge port 1411*a*.

The first fixed side wall 1412 may be configured in an annular shape by axially extending from an edge of a first side surface (an upper surface) of the first fixed end plate 1411 toward a first scroll side wall 1321 of the main frame 130. The first fixed side wall 1412 may be coupled to the first frame side wall 1321 axially face the first frame side wall 1321.

A first suction port 1421 is disposed in the first fixed side wall 1412 to penetrate through the first fixed side wall 1412 in a radial direction. As described above, an end portion of the first suction pipe 1151 having penetrated through the cylindrical shell 111 may be inserted and coupled into the first suction port 1421. Accordingly, some of a refrigerant discharged from the evaporator is sucked into the first compression chambers V1 through the first suction pipe 1151 of the refrigerant suction pipe 115 and the first suction port 1421*a*.

The first bearing protrusion 1413 is disposed to axially extend from a central portion of the first fixed end plate 1411 toward the lower shell 113. The first bearing hole 1413*a* having a cylindrical shape may be disposed through a center of the first bearing protrusion 1413 in an axial direction, and the first bearing portion 1252 of the rotating shaft 125 may be inserted into the first bearing hole 1413*a* to be supported in a radial direction.

The first fixed wrap 1414 may be disposed to extend from an upper surface of the first fixed end plate 1411 toward the first orbiting scroll 151 in an axial direction. The first fixed wrap 1414 is engaged with a first orbiting wrap 1512 to be described later to define the pair of first compression chambers V1.

The first fixed wrap 1414 may be configured in an involute shape. However, the first fixed wrap 1414 may be configured in various shapes other than the involute shape, together with the first orbiting wrap 1512. For example, the first fixed wrap 1414 may be configured in a substantially elliptical shape in which a plurality of arcs having different diameters and origins are connected and an outermost curve may have a major axis and a minor axis. The first orbiting wrap 1512 may be configured like the first fixed wrap 1414.

Referring to FIGS. 1 and 2, the first orbiting scroll 151 according to the present embodiment includes a first orbiting end plate 1511, the first orbiting wrap 1512, and a first rotating shaft coupling portion 1513.

The first orbiting end plate 1511 is configured to have a disk shape to be accommodated in a first space between the main frame 130 and the first fixed scroll 141. In other words, a first side surface (an upper surface) of the first orbiting end plate 1511 may be axially supported on the first side surface of the main frame 130, that is, the first scroll support portion 1341.

A first orbiting key groove 1511*a* is disposed on both sides of an edge of the first side surface (the upper surface) of the first orbiting end plate 1511. A first orbiting key 1613 of the first Oldham ring 161 to be described later is slidably inserted and coupled into the first orbiting key groove 1511*a*. The first orbiting scroll 151 slides to perform an orbiting motion in a state of being axially supported on the first scroll support portion 1341 of the main frame 130.

In addition, a first back pressure sealing member 155 is disposed between the first orbiting end plate 1511 and the first scroll support portion 1341 facing the first orbiting end plate 1511. For example, a first sealing groove (not shown) may be disposed in the first orbiting end plate 1511 to have an annular shape, and the first back pressure sealing member 155 may be inserted into the first sealing groove. The first back pressure sealing member 155 may be configured in an annular shape to surround the first bearing hole 1413*a*, and the first back pressure sealing member 155 may be disposed eccentrically with respect to the axial center O of the rotating shaft 125. Accordingly, a first space between the first orbiting end plate 1511 and the first scroll support portion 1341 facing the same may define a first back pressure chamber 171, and with reference to the first back pressure sealing member 155, an inner space of the first back pressure chamber 171 defines a first inner back pressure chamber 171*a* and an outer space thereof defines a first outer back pressure chamber 171*b*.

In addition, the first back pressure chamber 171 communicates with an oil supply passage 126 defining a discharge pressure and the first bearing hole 1413*a*. Thus, the first inner back pressure chamber 171*a* defines a discharge pressure space and the first outer back pressure chamber 171*b* defines an intermediate pressure space, with the first back pressure sealing member 155 interposed therebetween. The first back pressure chamber 171 and the second back pressure chamber 172 will be described later, together with a back pressure communication unit 180.

The fixed orbiting wrap 1512 may be disposed to extend from a second side surface (a bottom surface) of the first fixed end plate 1511 toward the first fixed scroll 141. The first orbiting wrap 1512 is engaged with the first fixed wrap 1414 to define the first compression chambers V1.

Since the first orbiting wrap 1512 is configured to correspond to a shape of the first fixed wrap 1414 described above, a description of the first orbiting wrap 1512 will be replaced by the description of the first fixed wrap 1414. However, an inner end portion of the first orbiting wrap 1512 may be disposed in a central portion of the first orbiting end plate 1511, and the first rotating shaft coupling portion 1513 may be disposed through the central portion of the first orbiting end plate 1511 in an axial direction.

The first eccentric portion 1255 of the rotating shaft 125 may be rotatably inserted and coupled into the first rotating shaft coupling portion 1513. An outer circumferential part of the first rotating shaft coupling portion 1513 is connected to the first orbiting wrap 1512 to define the first compression chambers V1 together with the first fixed wrap 1414 during a compression process.

The first rotating shaft coupling portion 1513 may be disposed at a height that overlaps with a height of the first orbiting wrap 1512 on a same plane. That is, the first rotating shaft coupling portion 1513 may be placed at a height at which the first eccentric portion 1255 of the rotating shaft 125 overlaps the first orbiting wrap 1512 on the same plane. Accordingly, repulsive force and compressive force of a refrigerant may cancel each other while being applied to the same plane based on the first orbiting end plate portion 1511, and thus inclination of the first orbiting scroll 151 due to an interaction between the compressive force and the repulsive force may be suppressed.

As described above, the first Oldham ring 161 is disposed between the main frame 130 and the first orbiting scroll 151 facing the main frame 130. Accordingly, the first orbiting scroll 151 performs an orbiting motion with respect to the main frame 130 by the first Oldham ring 161.

The first Oldham ring 161 includes a first ring body 1611, the first fixed key 1612, and the first orbiting key 1613. The first ring body 1611 is inserted into the first Oldham ring accommodation portion 1351. The first fixed key 1612 is slidably inserted into the first fixed key groove 1351*a* in the main frame 130. The first orbiting key 1613 is slidably inserted into the first orbiting key groove 1511*a* in the first orbiting scroll 151. The first Oldham ring 161 is identical to a generally known Oldham ring. Thus, a detailed description thereof is not provided here.

Although not shown in the drawing, the first compression unit C1 may include a first oil supply portion (not shown) in communication with the oil supply passage 126 of the rotating shaft 125 and configured to supply oil to the first compression chambers V1. The first oil supply portion may be disposed in the main frame 130, or in the first fixed scroll 141, or in the first orbiting scroll 151. For example, when disposed in the first fixed scroll 141, the first oil supply portion may be disposed to radially extend from an inner circumferential surface of the first bearing hole 1413*a* in the first fixed scroll 141 to communicate with the first compression chamber (an intermediate pressure chamber). Accordingly, some of oil supplied to the first bearing portion 1252 through the oil supply passage 126 may be supplied to the first compression chambers V1 through the first oil supply portion.

Additionally, the first oil supply portion may be disposed to be connected to two or more members among the members described above. For example, the first oil supply portion may communicate with the first Oldham ring accommodation portion 1351 on an inner circumferential surface of the shaft accommodation portion 133 of the main frame 130, and communicate with the first compression chamber V1 (the intermediate pressure chamber) through the first fixed side wall 1412 and the first fixed end plate 1411 on the first Oldham ring accommodation portion 1351. Accordingly, some of oil supplied to the first bearing portion 1252 through the oil supply passage 126 may be supplied to the first compression chamber V1 through the first oil supply portion.

Referring to FIGS. 1 and 2, the second compression unit C2 according to the present embodiment is located above the main frame 130, and the second compression unit C2 is disposed to be symmetrical to the first compression unit C1. For example, the second compression unit C2 includes the second fixed scroll 142 and the second orbiting scroll 152.

The second fixed scroll 142 may be fixed by being axially supported on the second side surface (the upper surface) of the main frame 130. The second orbiting scroll 152 may be rotatably supported on the second scroll support portion 1342 of the main frame 130 in a second space between the second side surface of the main frame 130 and the second fixed scroll 142 facing the second side surface of the main frame 130. Accordingly, a pair of second compression chambers V2 are defined between the second fixed scroll 142 and the second orbiting scroll 152 both constituting the second compression unit C2.

The second fixed scroll 142 according to the present embodiment may include a second fixed end plate 1421, a second fixed side wall 1422, a second bearing protrusion 1423, and a second fixed wrap 1424.

The second fixed end plate 1421 is configured in a disc shape, and has a second bearing hole 1423*a* disposed through a center in an axial direction, the second bearing hole 1423*a* constituting the second bearing protrusion 1423 to be described later. The second bearing hole 1423*a* is disposed on a same axial line as that of the shaft accommodation portion 133 of the main frame 130 and the first bearing hole 1413*a*. A bearing member configured as a bushing bearing, a ball bearing, or the like may be disposed on an inner circumferential surface of the second bearing hole 1423*a* to support the second bearing portion 1253 of the rotating shaft 125.

A second discharge port 1421*a* is disposed near the second bearing hole 1423*a*. The second discharge port 1421*a* is disposed to communicate between the second compression chambers V2 and the inner space 110*a* of the casing 110. Accordingly, a refrigerant compressed in the second compression chambers V2 is discharged into the inner space 110*a* of the casing 110 through the second discharge port 1421*a*.

The second fixed side wall 1422 may be configured in an annular shape by axially extending from an edge of a first side surface (a lower surface) of the second fixed end plate 1421 toward the second scroll side wall 1322 of the main frame 130. The second fixed side wall 1422 may be coupled to axially face the second frame side wall 1322.

The second suction port 1422*a* is disposed in the second fixed side wall 1422 to penetrate through the second fixed side wall 1422 in a radial direction. As described above, an end portion of the second suction pipe 1152 having penetrated through the cylindrical shell 111 may be inserted and coupled into the second suction port 1422*a*. Accordingly, some of a refrigerant discharged from the evaporator is sucked into the second compression chambers V2 through the second suction pipe 1152 of the refrigerant suction pipe 115 and the second suction port 1422*a*.

The second bearing protrusion 1423 may be disposed to axially extend from a central portion of the second fixed end plate 1421 toward the drive motor 120. The second bearing hole 1423*a* having a cylindrical shape may be disposed through a center of the second bearing protrusion 1423 in an axial direction, and the second bearing portion 1253 of the rotating shaft 125 may be inserted into the second bearing hole 1423*a* to be supported in a radial direction.

The second fixed wrap 1424 may be disposed to extend from the lower surface of the second fixed end plate 1421 toward the second orbiting scroll 152 in an axial direction. The second fixed wrap 1424 is engaged with a second orbiting wrap 1522 to be described later to define the pair of second compression chambers V2.

The second fixed wrap 1424 may be configured in an involute shape. However, the second fixed wrap 1424 may be configured in various shapes other than the involute shape, together with the second orbiting wrap 1522. For example, the second fixed wrap 1424 may be configured in a substantially elliptical shape in which a plurality of arcs having different diameters and origins are connected and an outermost curve may have a major axis and a minor axis. The second orbiting wrap 1522 may be configured like the second fixed wrap 1424.

Referring to FIGS. 1 and 2, the second orbiting scroll 152 according to the present embodiment includes a second orbiting end plate 1521, the second orbiting wrap 1522, and a second rotating shaft coupling portion 1523.

The second orbiting end plate 1521 is configured to have a disk shape to be accommodated in a second space between the main frame 130 and the second fixed scroll 142. In other words, a first side surface (a lower surface) of the second orbiting end plate 1521 may be axially supported on the second side surface of the main frame 130, that is, the second scroll support portion 1342.

A second orbiting key groove 1521*a* is disposed on both sides of an edge of the first side surface of the second orbiting end plate 1521. A second orbiting key 1623 of the second Oldham ring 162 to be described later is slidably inserted and coupled into the second orbiting key groove 1521*a*. The second orbiting scroll 152 slides to perform an orbiting motion while being axially supported on the second scroll support portion 1342.

In addition, a second back pressure sealing member 156 is disposed between the second orbiting end plate 1521 and the second scroll support portion 1342 facing the second orbiting end plate 1521. For example, a second sealing groove (not shown) may be disposed in the second orbiting end plate 1521 to have an annular shape so that the second back pressure sealing member 156 is inserted into the second sealing groove. The second back pressure sealing member 156 may be configured in an annular shape to surround the second bearing hole 1423*a*, and the second back pressure sealing member 156 may be disposed eccentrically with respect to the axial center O of the rotating shaft 125. Accordingly, a second space between the second orbiting end plate 1521 and the second scroll support portion 1342 facing the second orbiting end plate 1521 may define the second back pressure chamber 172, and with reference to the second back pressure sealing member 156, an inner space of the second back pressure chamber 172 defines a second inner back pressure chamber 172*a* and an outer space thereof defines a second outer back pressure chamber 172*b*.

In addition, the second back pressure chamber 172 communicates with the oil supply passage 126 defining a discharge pressure and the second bearing hole 1423*a*. Thus, the second inner back pressure chamber 172*a* defines a discharge pressure space and the second outer back pressure chamber 172*b* defines an intermediate pressure space, with the second back pressure sealing member 156 interposed therebetween.

The second orbiting wrap 1522 may be disposed to extend from a second side surface (an upper surface) of the second fixed end plate 1521 toward the first fixed scroll 141. The second orbiting wrap 1522 is engaged with the second fixed wrap 1424 to define the second compression chambers V2.

Since the second orbiting wrap 1522 is configured to correspond to a shape of the second fixed wrap 1424 described above, a description of the second orbiting wrap 1522 will be replaced by the description of the second fixed wrap 1424. However, an inner end portion of the second orbiting wrap 1522 may be disposed in a central portion of the second orbiting end plate 1521, and the second rotating shaft coupling portion 1523 may be disposed through the central portion of the second orbiting end plate 1521 in an axial direction.

The second eccentric portion 1256 of the rotating shaft 125 may be rotatably inserted and coupled into the second rotating shaft coupling portion 1523. An outer circumferential part of the second rotating shaft coupling portion 1523 is connected to the second orbiting wrap 1522 to function to define the second compression chambers V2 together with the second fixed wrap 1424 during a compression process.

The second rotating shaft coupling portion 1523 may be disposed at a height that overlaps with a height of the second orbiting wrap 1522 on a same plane. That is, the second rotating shaft coupling portion 1523 may be placed at a height at which the second eccentric portion 1256 of the rotating shaft 125 overlaps the second orbiting wrap 1522 on the same plane. Accordingly, repulsive force and compressive force of a refrigerant may cancel each other while being applied to the same plane based on the second orbiting end plate portion 1521, and thus inclination of the second orbiting scroll 152 due to an interaction between the compressive force and the repulsive force may be suppressed.

As described above, the second Oldham ring 162 is disposed between the main frame 130 and the second orbiting scroll 152 facing the main frame 130. Accordingly, the second orbiting scroll 152 performs an orbiting motion with respect to the main frame 130 by the second Oldham ring 162.

The second Oldham ring 162 includes a second ring body 1621, the second fixed key 1622, and the second orbiting key 1623. The second ring body is inserted into the second Oldham ring accommodation portion 1352. The second fixed key is slidably inserted into the second fixed key groove in the main frame 130. The second orbiting key is slidably inserted into the second orbiting key groove in the second orbiting scroll 152. Like the first Oldham ring 161, the second Oldham ring 162 is identical to a generally known Oldham ring. Thus, a detailed description thereof is not provided here.

Although not shown in the drawing, the second compression unit C2 may include a second oil supply portion (not shown) in communication with the oil supply passage 126 of the rotating shaft 125 and configured to supply oil to the second compression chambers V2. The second oil supply portion may be disposed in the main frame 130, or in the second fixed scroll 142, or in the second orbiting scroll 152. For example, when disposed in the second fixed scroll 142, the second oil supply portion may be disposed to radially extend from an inner circumferential surface of the second bearing hole 1423*a* in the second fixed scroll 142 to communicate with the second compression chamber V2 (an intermediate pressure chamber). Accordingly, some of oil supplied to the second bearing portion 1253 through the oil supply passage 126 may be supplied to the second compression chambers V2 through the second oil supply portion.

Additionally, the second oil supply portion may be disposed to be connected to two or more members among the members described above. For example, the second oil supply portion may communicate with the second Oldham ring accommodation portion 1352 in an inner circumferential surface of the shaft accommodation portion 133 of the main frame 130, and communicate with the second compression chamber V2 (an intermediate pressure chamber)

through the second fixed side wall 1422 and the second fixed end plate 1421 on the second Oldham ring accommodation portion 1352. Accordingly, some of oil supplied to the second bearing portion 1253 through the oil supply passage may be supplied to the second compression chamber V2 through the second oil supply portion.

The scroll compressor according to the present embodiment may operate as follows.

That is, when power is applied to the drive motor 120, rotational force may be generated in the rotor 122, and the rotor 122 rotates. Then, the rotating shaft 125 coupled to the rotor 122 rotates, and the first orbiting scroll 151 coupled to the first eccentric portion 1255 of the rotating shaft 125 performs an orbiting motion with respect to the first fixed scroll 141 by the first Oldham ring 161, and at the same time, the second orbiting scroll 152 coupled to the second eccentric portion 1256 of the rotating shaft 125 performs an orbiting motion with respect to the second fixed scroll 142 by the second Oldham ring 162.

Then, volume of the first compression chambers V1 and the second compression chambers V2 gradually decreases from suction pressure chambers located outside the respective compression chambers V1 and V2 to respective intermediate pressure chambers, and respective discharge pressure chambers which are sequentially disposed toward a center.

Then, a refrigerant having passed through a refrigeration cycle device is sucked into a first suction pressure chamber constituting the first compression chambers V1 through the first suction pipe 1151 of the refrigerant suction pipe 115, and into the second suction pressure chamber constituting the second compression chambers V2 through the second suction pipe 1152.

Then, the refrigerant sucked into each suction pressure chamber is compressed while moving to each discharge pressure chamber via each intermediate pressure chamber along movement trajectories in the first compression chambers V1 and the second compression chambers V2, and the refrigerant compressed in the first compression chambers V1 is discharged into the discharge space 1451 of the discharge cover 145 through the first discharge port 1411*a*, and the refrigerant compressed in the second compression chambers V2 is discharged into the inner space 110*a* of the casing 110 through the second discharge port 1421*a*.

Then, the refrigerant discharged from the first compression chamber V1 to the discharge space 1451 of the discharge cover 145 is guided to a discharge space S12 between the drive motor 120 and the compression unit C through the refrigerant discharge passage Fg disposed in the first fixed scroll 141, the main frame 130, and the second fixed scroll 142. In the second compression chambers V2, this refrigerant is mixed with a refrigerant discharged into the inner space 110*a* of the casing 110, then, passes through the drive motor 120. Thereafter, oil is separated from the refrigerant having passed through the drive motor 120 in the upper space S2. This refrigerant moves toward the condenser in a refrigeration cycle through the refrigerant discharge pipe 116, and the oil separated from the refrigerant in the upper space S2 is returned to the lower space S1 of the casing 110, i.e., the oil storage space S11 through the oil return passage Fo between the casing 110 and the stator 121 and between the casing 110 and the compression unit C. This oil may be supplied to each bearing surface (not shown) through the oil supply passage 126, and partially supplied into the compression chamber V. This series of processes may be repeatedly performed.

Meanwhile, as described above, the scroll compressor according to the present embodiment is configured such that the first back pressure chamber is disposed in the first compression unit and the second back pressure chamber is disposed in the second compression unit to have the main frame therebetween, and the first back pressure chamber is divided into the first inner back pressure chamber defining a discharge pressure and the first outer back pressure chamber defining an intermediate pressure by the first back pressure sealing member, and the second back pressure chamber is divided into the second inner back pressure chamber defining a discharge pressure and the second outer back pressure chamber defining an intermediate pressure by the second back-pressure sealing member. Accordingly, a discharge side (a central portion) where relatively high gas repulsive force is defined in the first compression chamber is supported by back pressure in the first inner back pressure chamber that defines a discharge pressure, and a suction side (an edge) where relatively low gas repulsive force is defined is supported by back pressure in the first outer back pressure chamber that defines the intermediate pressure. Thus, the first orbiting scroll may be suppressed from being separated from the first fixed scroll, as well as coming into excessive contact therewith, thereby increasing compression efficiency in the first compression unit. This also applies to the second compression unit.

However, in a case of an abnormal operation of the compressor, lifting of the first back pressure sealing member and/or the second back pressure sealing member may be delayed, and thus, the first inner back pressure chamber and the first outer back pressure chamber, and/or the second inner back pressure chamber and the first outer back pressure chamber may not be separated from each other but may communicate with each other. Then, since a whole of the first back pressure chamber and/or a whole of the second back pressure chamber define a discharge pressure, the first orbiting scroll and the first fixed scroll, and/or the second orbiting scroll and the second fixed scroll may be in excessive contact with each other. Thus, a friction loss may increase and a damage may occur between the both scrolls.

Accordingly, in the present embodiment, a back pressure communication unit is disposed between a first back pressure chamber and a second back pressure chamber. Thus, when back pressure in one back pressure chamber among the first and second back pressure chambers increases excessively, oil in the one back pressure chamber may leak into another back pressure chamber. Thus, an appropriate back pressure may be recovered in the one back pressure chamber, thereby suppressing a friction loss and damage in a corresponding compression unit.

Figure 3:
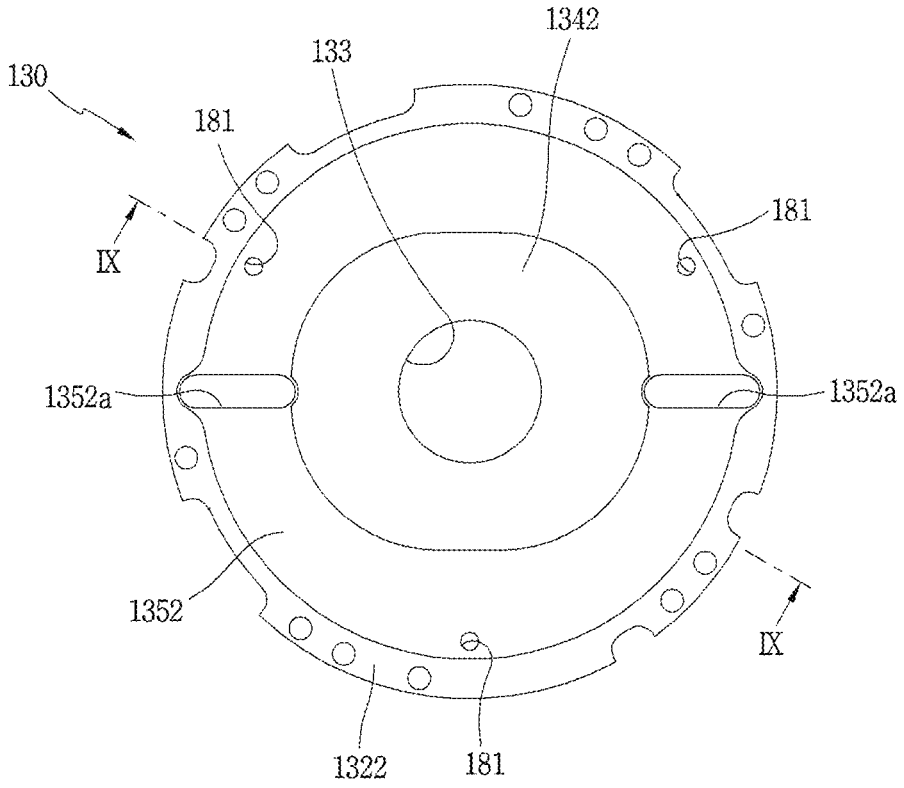
FIG. 3 is a planar view illustrating a main frame including a back pressure communication unit according to the present embodiment.
Figure 4:
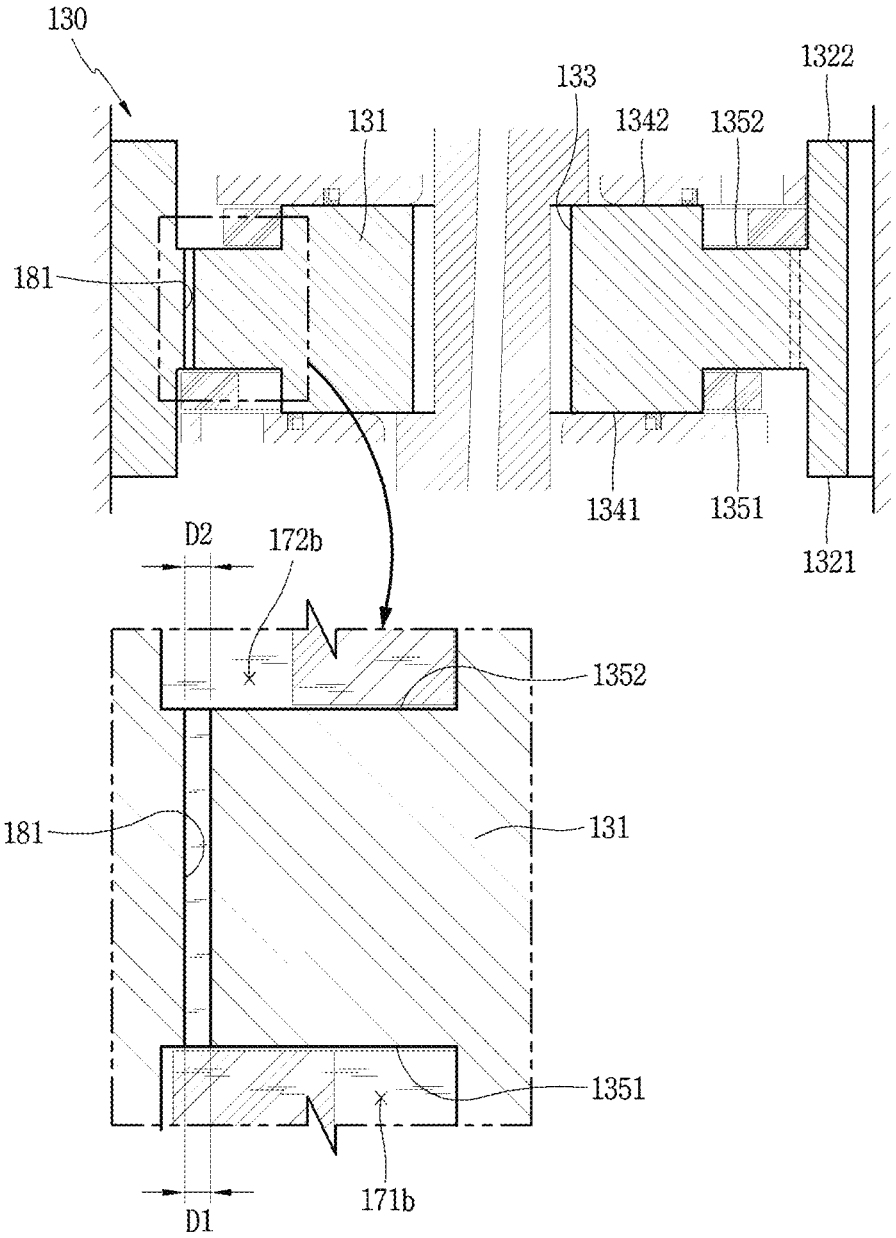
FIG. 4 is a sectional view taken along the "IX-IX" of FIG. 3.
Figure 5:
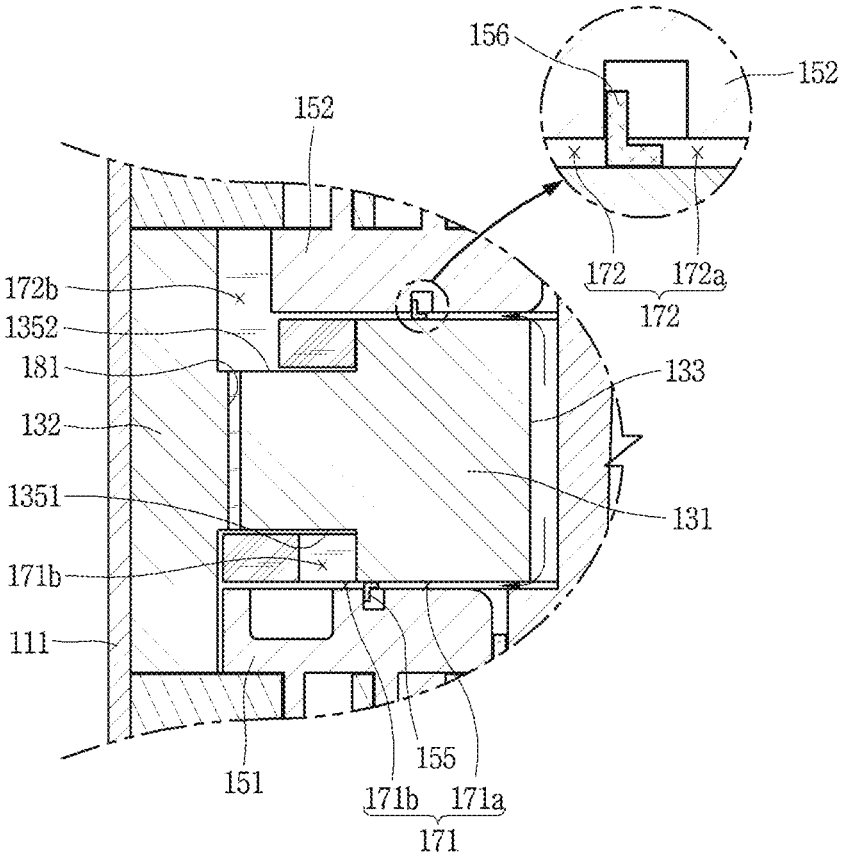
FIGS. 5 and 6 are sectional views illustrating a periphery of the back pressure communication unit according to an operation state of the compressor of FIG. 1.
Figure 6:
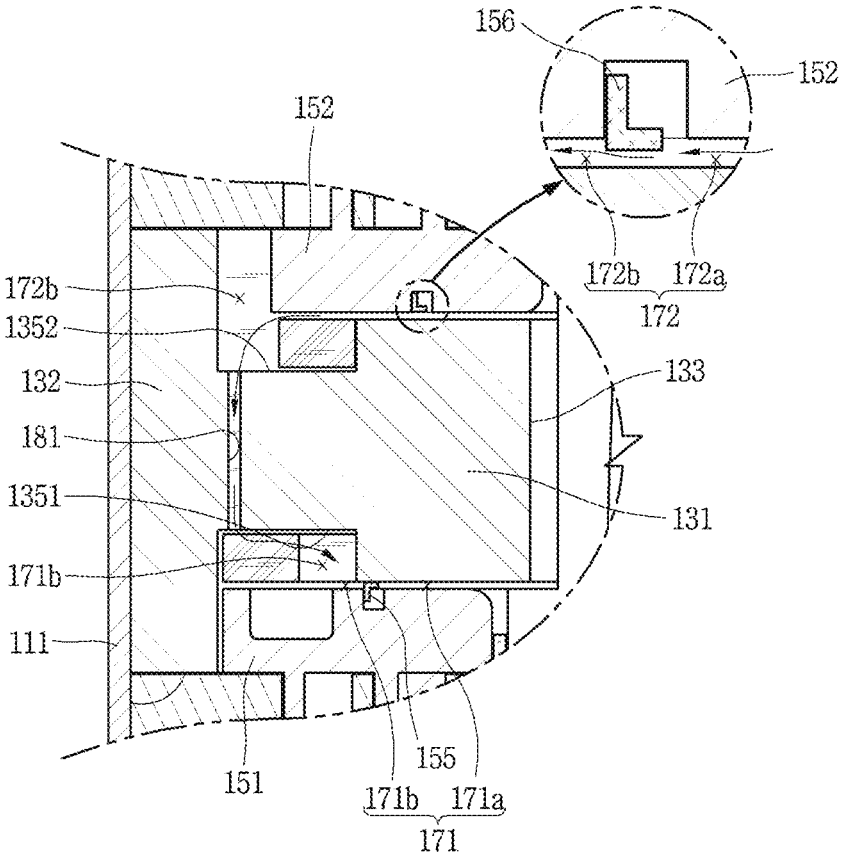

FIG. 3 is a planar view illustrating the main frame including the back pressure communication unit according to the present embodiment. FIG. 4 is a sectional view taken along line "IX-IX" of FIG. 3. FIGS. 5 and 6 are sectional views illustrating a periphery of the back pressure communication unit according to an operation state of the compressor of FIG. 1. FIG. 5 shows a state of a normal operation. FIG. 6 shows a state of an abnormal operation.

Referring back to FIG. 2, in the scroll compressor according to the present embodiment, the back pressure communication unit 180 may include a back pressure communication hole 181 penetrating between a first side surface of the main frame 130 defining the first back pressure chamber 171 and a second side surface of the main frame 130 defining the second back pressure chamber 172.

The back pressure communication hole 181 may be configured as a single hole or a plurality of holes along a circumferential direction. In the present embodiment, an example in which a plurality of back pressure communication holes 181 are disposed is described. However, since the plurality of back pressure communication holes 181 are configured in a same shape, one back pressure communication hole 181 is described as a representative example hereinafter.

Referring to FIGS. 3 and 4, the back pressure communication hole 181 may be disposed therethrough in an axial direction. One end of the back pressure communication hole 181 may communicate with the first outer back pressure chamber 171*b*, and another end of the back pressure communication hole 181 may communicate with the second outer back pressure chamber 172*b*. In other words, the one end of the back pressure communication hole 181 may communicate with the first Oldham ring accommodation portion 1351, and the another end of the back pressure communication hole 181 may communicate with the second Oldham ring accommodation portion 1352. Accordingly, not only a length of the back pressure communication hole 181 may be minimized to be easily machined, but also oil may quickly and smoothly move between the first and second back pressure chambers 171 and 172 to quickly decrease a pressure in a corresponding back pressure chamber.

The back pressure communication hole 181 according to the present embodiment may be configured such that a first inner diameter D1 of a first end in communication with the first pressure chamber 171 is identical to a second inner diameter D2 of a second end in communication with the second pressure chamber 172. In this case, the first inner diameter D1 and the second inner diameter D2 of the back pressure communication hole 181 may be configured to be as small as approximately 1 to 2 mm. Accordingly, during a normal operation, oil (or a refrigerant) in the second back pressure chamber 172 located at a relatively upper side may be prevented from being leaked into the first back pressure chamber 171 located at a relatively lower side.

Although not shown in the drawing, the back pressure communication hole 181 may be disposed in plurality, and the plurality of communication holes 181 may be disposed at a preset interval along a circumferential direction. In this case, the back pressure communication holes 181 may be disposed respectively at an equal interval along the circumferential direction, but in some cases, may be disposed at different intervals. However, when the plurality of back pressure communication holes 181 are disposed, it may be advantageous to place the back pressure communication holes 181 at an equal interval to uniformly secure a back pressure along the circumferential direction.

Hereinafter, an operating effect of the back pressure communication unit according to the present embodiment is described.

That is, in a case of a start-up operation of the compressor, some of oil pumped through the oil supply passage 126 is supplied to the first back pressure chamber 171 and the second back pressure chamber 172 through each of the oil supply holes 126*a* to 126*d*. As the oil defines a discharge pressure, the first back pressure sealing member 155 and the second back pressure sealing member 156 are quickly lifted from sealing grooves, respectively, due to a pressure and a temperature of the oil, thereby dividing the first back pressure chamber 171 into the first inner back pressure chamber 171*a* and the first outer back pressure chamber 171*b*, and the second back pressure chamber 172 into the second inner back pressure chamber 172*a* and the second outer back pressure chamber 172*b*.

Then, the first inner back pressure chamber 171*a* and the second inner back pressure chamber 172*a* each define a back pressure according to a discharge pressure, and the first outer back pressure chamber 171*b* and the second outer back pressure chamber 172*b* each define a back pressure according to an intermediate pressure. Then, a central portion of the first and second orbiting scrolls is supported by the back pressure according to the discharge pressure, and an edge of the first and second orbiting scrolls is supported by the back pressure according to the intermediate pressure. As illustrated in FIG. 5, such a state is secured when the first back pressure sealing member 155 and/or the second back pressure sealing member 156 are quickly lifted and the compressor starts normally. Thus, a friction loss or damage in the first compression unit C1 and the second compression unit C2 may be suppressed.

However, when the lifting of the first back pressure sealing member 155 and/or the second back pressure sealing member 156 is delayed and the compressor starts abnormally, the first outer back pressure chamber 171*b* may communicate with the first inner back pressure chamber 171*a* or the second outer back pressure chamber 172*b* may communicate with the second inner back pressure chamber 172*a*. Thus, a back pressure in the first outer back pressure chamber 171*b* or the second outer back pressure chamber 172*b* may excessively increase. In this case, oil in the first or second outer back pressure chamber 171*b* or 172*b* having relative high back pressure may leak into the first or second outer back pressure chamber 172*b* or 171*b* having a relatively low back pressure to thereby prevent the back pressure in the first outer back pressure chamber 171*b* or the second outer back pressure chamber 172*b* from increasing excessively.

For example, as illustrated in FIG. 6, when the first back pressure sealing member 155 is lifted normally but lifting of the second back pressure sealing member 156 is delayed, the first outer back pressure chamber 171*b* defines an intermediate pressure, whereas the second outer back pressure chamber 172*b* defines a discharge pressure as high-pressure oil is introduced from the second inner back pressure chamber 172*a*.

Then, since the back pressure communication hole 181 communicates between the first outer pressure chamber 171*b* and the second outer pressure chamber 172*b*, oil in the second outer pressure chamber 172*b* leaks into the first outer pressure chamber 171*b* through the back pressure communication hole 181. Then, a back pressure in the second outer back pressure chamber 172*b* having defined a discharge pressure momentarily constitutes a pressure lower than the discharge pressure, e.g., an intermediate pressure. Thus, a suction side (an edge) of the second orbiting scroll 152 may be prevented from being brought into excessive contact with a suction side (an edge) of the second fixed scroll 142 when the compressor is started. By doing so, like in the normal operation described above, a friction loss or damage in the second compression unit C2 may be suppressed.

Thereafter, the second back pressure sealing member 156 is normally lifted to block a space between the second inner back pressure chamber 172*a* and the second outer back pressure chamber 172*b*. Thus, leakage between compression chambers located between the second orbiting scroll 152 and the second fixed scroll 142 may be suppressed, while the second orbiting scroll 152 and the second fixed scroll 142 may not be in excessive contact with each other, thus increasing compression efficiency.

During a normal operation of the compressor as described above, even when the second outer pressure chamber 172*b* is located above the first outer pressure chamber 171*b*, oil in the second outer pressure chamber 172*b* may not leak into the first outer pressure chamber 171*b*. In other words, the first outer back pressure chamber 171*b* and the second outer back pressure chamber 172*b* are almost in a state of pressure balance, and during a normal operation, oil in the second outer back pressure chamber 172*b* does not leak into the first outer back pressure chamber 171*b* through the back pressure communication hole 181 having a small width due to viscosity of the oil.

This applies identically to a case when lifting of the first back pressure sealing member 155 is delayed or when the lifting of both the first back pressure sealing member 155 and the second back pressure sealing member 156 is delayed. Thus, a detailed description thereof is not provided here.

By doing so, when the compressor starts, even when a back pressure in the first back pressure chamber 171 and/or the second back pressure chamber 172 increases to be equal to or greater a set pressure, a pressure in a back pressure chamber having a relatively high back pressure may be transferred to a back pressure chamber having a relatively low back pressure. This allows to quickly recover an appropriate back pressure in both the back pressure chambers. Thus, a friction loss and damage in a compression unit may be suppressed, and simultaneously, leakage between compression chambers may be suppressed to increase compression efficiency.

Hereinafter, a description will be given of another embodiment of a back pressure communication unit.

That is, in the embodiment described above, a back pressure communication hole is configured to have one inner diameter. However, in some cases, a back pressure communication hole may be configured to have a plurality of diameters.

Figure 7:
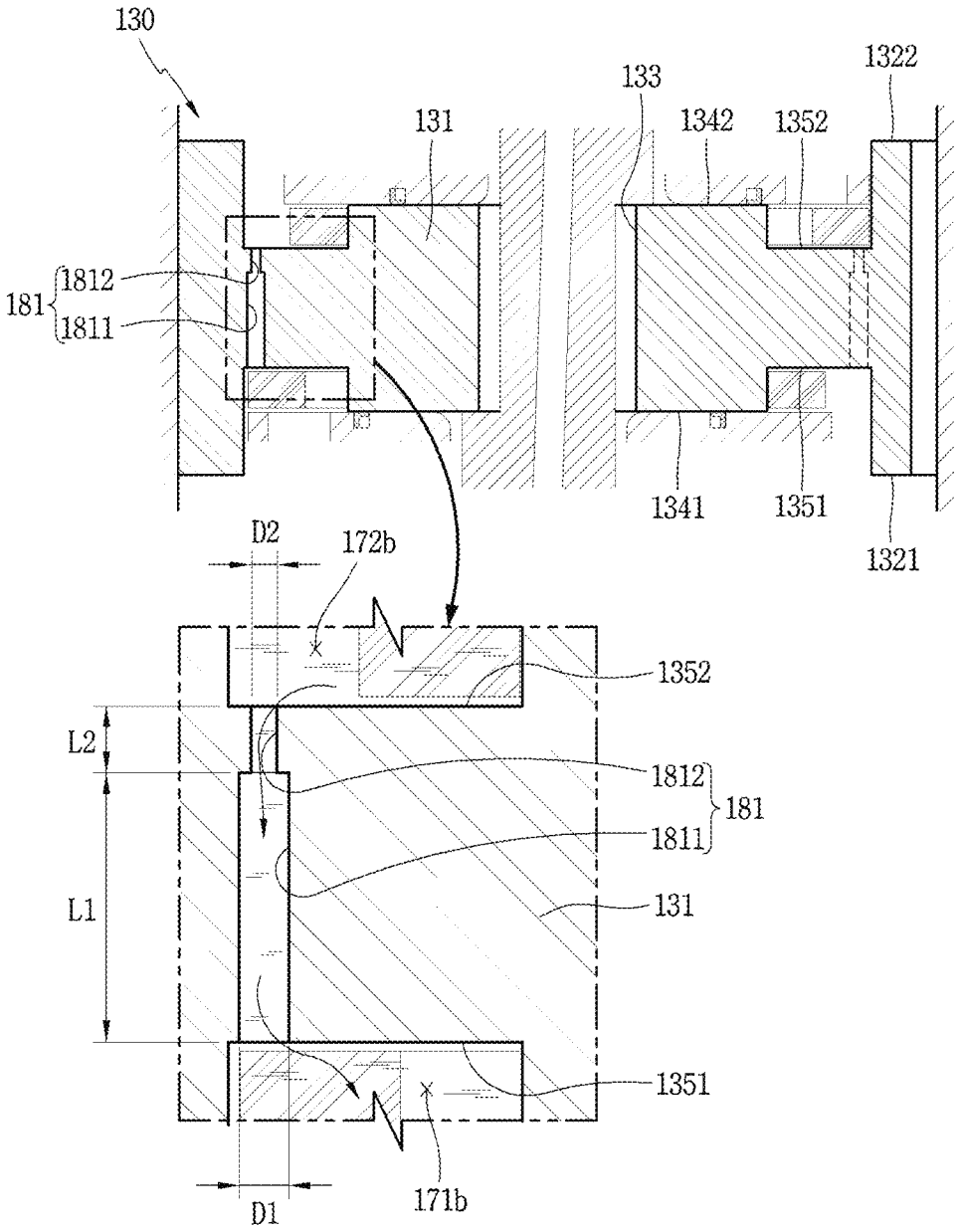
FIG. 7 is a longitudinal sectional view illustrating another embodiment of the back pressure communication unit.

FIG. 7 is a longitudinal sectional view illustrating another embodiment of the back pressure communication unit.

Referring to FIG. 7, a basic configuration of the scroll compressor according to the present embodiment and an operating effect thereof are similar to those in the aforementioned embodiments. For example, the scroll compressor according to the present embodiment has the drive motor 120 disposed inside the casing 110. The rotating shaft 125 of the drive motor 120 is equipped with the first eccentric portion 1255 and the second eccentric portion 1256. The first orbiting scroll 151 is coupled to the first eccentric portion 1255 to define the first compression unit C1 having the first compression chambers V1 together with the first fixed scroll 141, and the second orbiting scroll 152 is coupled to the second eccentric portion 1256 to define the second compression unit C2 having the second compression chamber V2 together with the second fixed scroll 142. Accordingly, a refrigerant sucked into the first compression unit C1 through the first suction pipe 1151 of the refrigerant suction pipe 115 is compressed in the first compression unit C1 to be discharged into the inner space 110*a* of the casing 110, and a refrigerant sucked into the second compression unit C2 through the second suction pipe 1152 of the refrigerant suction pipe 115 is compressed in the second compression unit C2 to be discharged into the inner space 110*a* of the casing 110.

In addition, the main frame 130 is disposed between the first compression unit C1 and the second compression unit C2 to separate the first compression unit C1 from the second compression unit C2. However, the back pressure communication hole 181 in communication between the first outer back pressure chamber 171*b* and the second outer back pressure chamber 172*b* may be disposed in the main frame 130. Accordingly, when a back pressure in the first outer back pressure chamber 171*b* and/or a back pressure in the second outer back pressure chamber 172*b* excessively increase, oil may be leaked into an outer back pressure chamber with a relatively low back pressure, thereby suppressing a friction loss and damage in a corresponding compression unit C1 or C2.

However, in the present embodiment, since the back pressure communication hole 181 is configured to have a plurality of inner diameters, the back pressure communication hole 181 may be easily machined.

In detail, the back pressure communication hole 181 according to the present embodiment may include a first communication hole 1811 and a second communication hole 1812. The first communication hole 1811 and the second communication hole 1812 are sequentially disposed, and the first communication hole 1811 may communicate with the first outer back pressure chamber 171*b* and the second communication hole 1812 may communicate with the second outer back pressure chamber 172*b*, respectively. Accordingly, the first outer pressure chamber 171*b* and the second outer pressure chamber 172*b* may communicate with each other through the first communication hole 1811 and the second communication hole 1812.

A first inner diameter of the first communication hole 1811 may be configured to be greater than a second inner diameter of the second communication hole 1812. A first length L1 of the first communication hole 1811 may be configured to be greater than a second length L2 of the second communication hole 1812. In other words, the first communication hole 1811 may be configured to be larger and longer than the second communication hole 1812.

For example, when the second inner diameter D2 of the second communication hole 1812 is configured to be approximately 1 to 2 mm like in the embodiment descried above, the first inner diameter D1 of the first communication hole 1811 may be configured to be approximately 3 to 5 mm, which is approximately twice or greater than the second inner diameter D2 of the second communication hole 1812. The first length L1 of the first communication hole 1811 may be configured to be approximately twice or greater than the second length L2 of the second communication hole 1812.

As described above, when the first communication hole 1811 is configured to be larger and longer than the second communication hole 1812, the back pressure communication hole 181 may be configured to be narrow and long, but easily machined. By doing so, during a normal operation, oil accommodated in the second back pressure chamber 172 located at an upper side may be suppressed from being leaked into the first back pressure chamber 171 located at a lower side due to a weight of the oil.

Although not shown in the drawing, the first inner diameter D1 of the first communication hole 1811 may be configured to be smaller than the second inner diameter D2 of the second communication hole 1812, and the first length L1 of the first communication hole 1811 may be configured to be smaller than the second length L2 of the second communication hole 1812. In this case, a ratio between the first communication hole 1811 and the second communication hole 1812 may be also configured to be identical to that in the above-described embodiment. Since an operation effect resulting therefrom is almost identical similar to that of the embodiments described above, a detailed description thereof will not be provided here.

Hereinafter, a description will be given of still another embodiment of the back pressure communication unit.

That is, in the above-described embodiment, the back pressure communication unit is configured only as a back pressure communication hole. However, in some cases, a pin member may be inserted into the back pressure communication unit.

Figure 8:
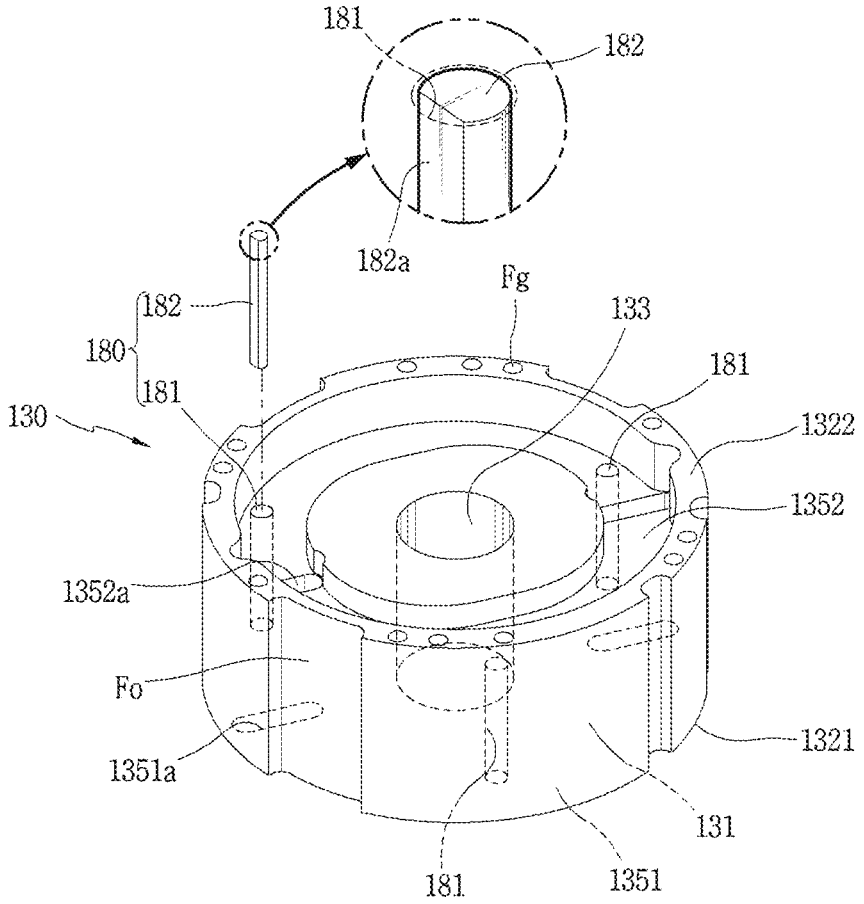
FIG. 8 is an exploded perspective view illustrating still another embodiment of the back pressure communication unit.
Figure 9:
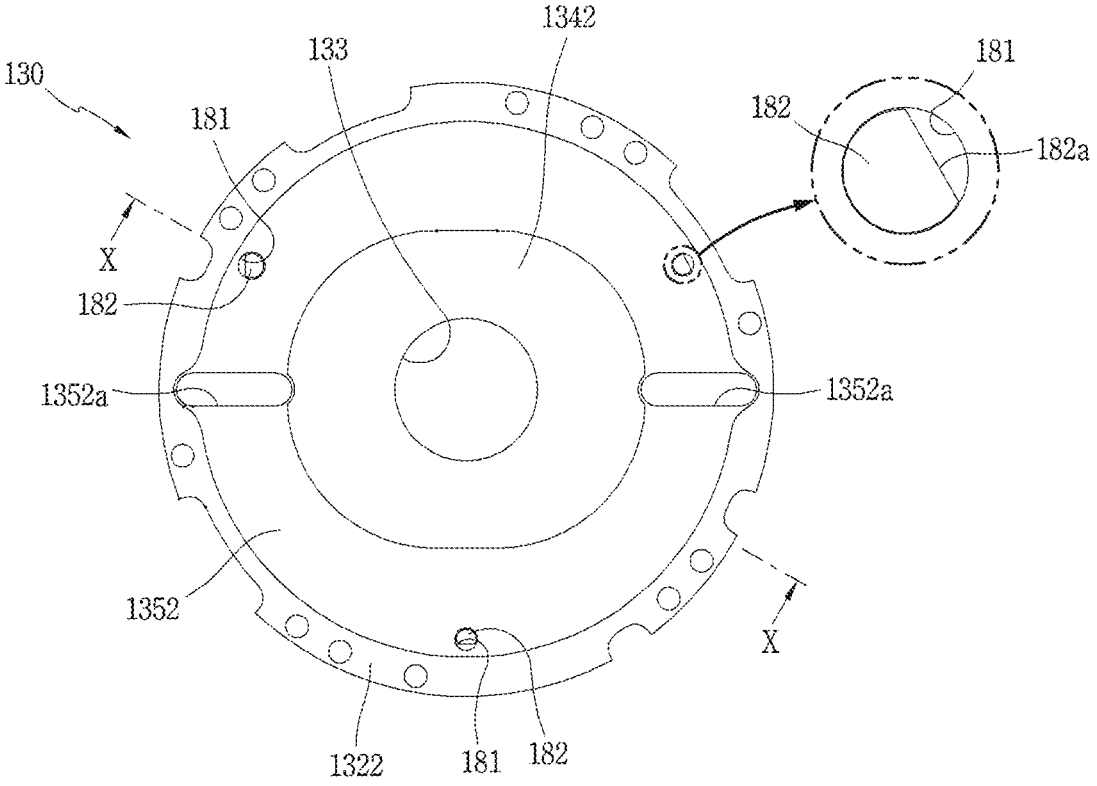
FIG. 9 is an assembled planar view of FIG. 8.
Figure 10:
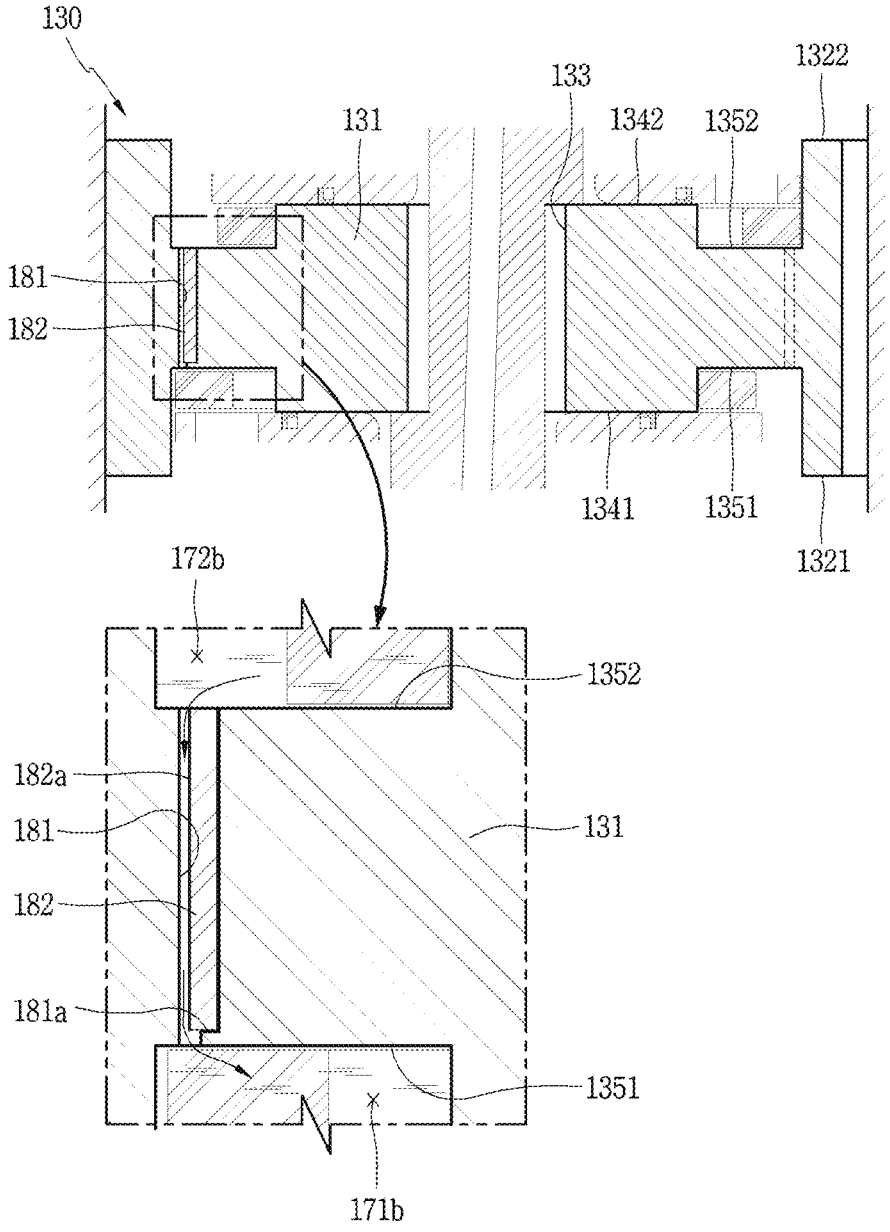
FIG. 10 is a sectional view taken along line "X-X" of FIG. 9.

FIG. 8 is an exploded perspective view illustrating still another embodiment of the back pressure communication unit. FIG. 9 is an assembled planar view of FIG. 8. FIG. 10 is a sectional view taken along line "X-X" of FIG. 9.

Referring to FIGS. 8 to 10, a basic configuration of the scroll compressor according to the present embodiment and an operating effect thereof are similar to those in the embodiments described above. For example, the first compression unit C1 and the second compression unit C2 may be separated from each other by the main frame 130, and the main frame 130 may include the back pressure communication unit 180 configured to communicate between the first back pressure chamber 171 of the first compression unit C1 and the second back pressure chamber 172 of the second compression unit C2. When a back pressure in the first back pressure chamber 171 and/or the second back pressure chamber 172 is increased excessively, the back pressure communication unit 180 may cause oil to be leaked into a back pressure chamber having a relatively low back pressure to properly maintain a back pressure in the corresponding back pressure chamber. A detailed description thereof is replaced by the description of the embodiments with respect to FIGS. 4 and 7.

However, in the present embodiment, the back pressure communication hole 181 is configured to have one inner diameter, and a pin member 182 may be inserted and fixed into the back pressure communication hole 181. In this case, a sectional area of the pin member 182 may be configured to be smaller than that of the back pressure communication hole 181 so that a back pressure passage (not shown) is disposed between an inner circumferential surface of the back pressure communication hole 181 and an outer circumferential surface of the pin member 182.

The pin member 182 may be screw-fastened or press-fit. In this case, the back pressure communication hole 181 may be configured to be larger than that in the above-described embodiments, e.g., to be about 4 to 6 mm to be capable of easily machining the back pressure communication hole 181 and securing the back pressure passage (not shown) having a small width and a great length.

In detail, when the pin member 182 is screw-fastened, a back pressure passage (not shown) may be disposed between screw threads on both sides, or a separate back pressure passage (not shown) may be disposed on one side of an inner circumferential surface of the back pressure communication hole 181. Accordingly, the pin member 182 may be firmly fixed to the back pressure communication hole 181 while a narrow back pressure passage (not shown) may be secured.

When the pin member 182 is press-fit, a separate back pressure passage (not shown) may be further disposed on an inner circumferential surface of the back pressure communication hole 181, or a back pressure passage 182*a* having a D-cut or recessed shape may be further disposed in an outer circumferential surface of the pin member 182 as shown in FIG. 8. Accordingly, the pin member 182 may be easily fixed to the back pressure communication hole 181 while securing the back pressure passage 182*a* having a small width.

In this case, a support surface 181*a* may be disposed to have a step at one end of the back pressure communication hole 181 to support the pin member 182 in an axial direction. Accordingly, the pin member 182 may be press-fit into the back pressure communication hole 181, while being effectively suppressed from being separated in an axial direction.

Additionally, a sectional area of the support surface may be configured to be smaller than or equal to a sectional area of the pin member 182. Accordingly, the pin member 182 may be stably supported in an axial direction, while an area of the back pressure passage may be secured.

As described above, in a case when the pin member 182 is inserted into the back pressure communication hole 181, the back pressure communication hole 181 may be configured to have a large area with one inner diameter. In correspondence with this, the back pressure communication hole 181 may be easily machined.

Although not shown in the drawing, the pin member 182 may be fixed by a fastening screw (not shown) fastened in a direction intersecting with the back pressure communication hole 181 or fixed by a fastening screw (not shown) fastened in a same direction as that of the back pressure communication hole 181 at one side of the back pressure communication hole 181. In this case, the pin member 182 that receives a pressure of the first back pressure chamber 171 or a pressure of the second back pressure chamber 172 may be more stably fixed into the back pressure communication hole 181.

Hereinafter, a description will be given of still another embodiment of the back pressure communication unit.

That is, in the above-described embodiment, the back pressure communication hole is in an open state at all times, but in some cases, a valve may be disposed to open or close the back pressure communication hole.

Figure 11:
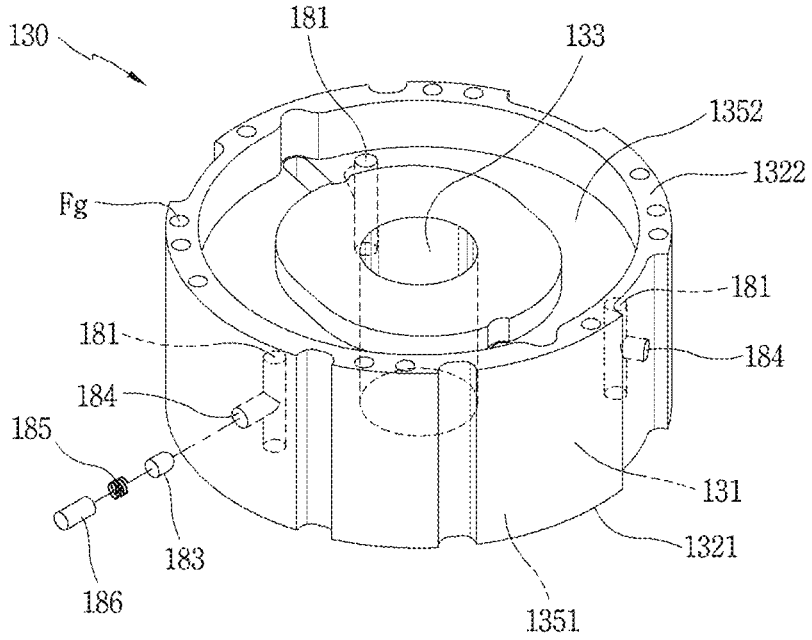
FIG. 11 is an exploded perspective view illustrating still another embodiment of the back pressure communication unit.
Figure 12:
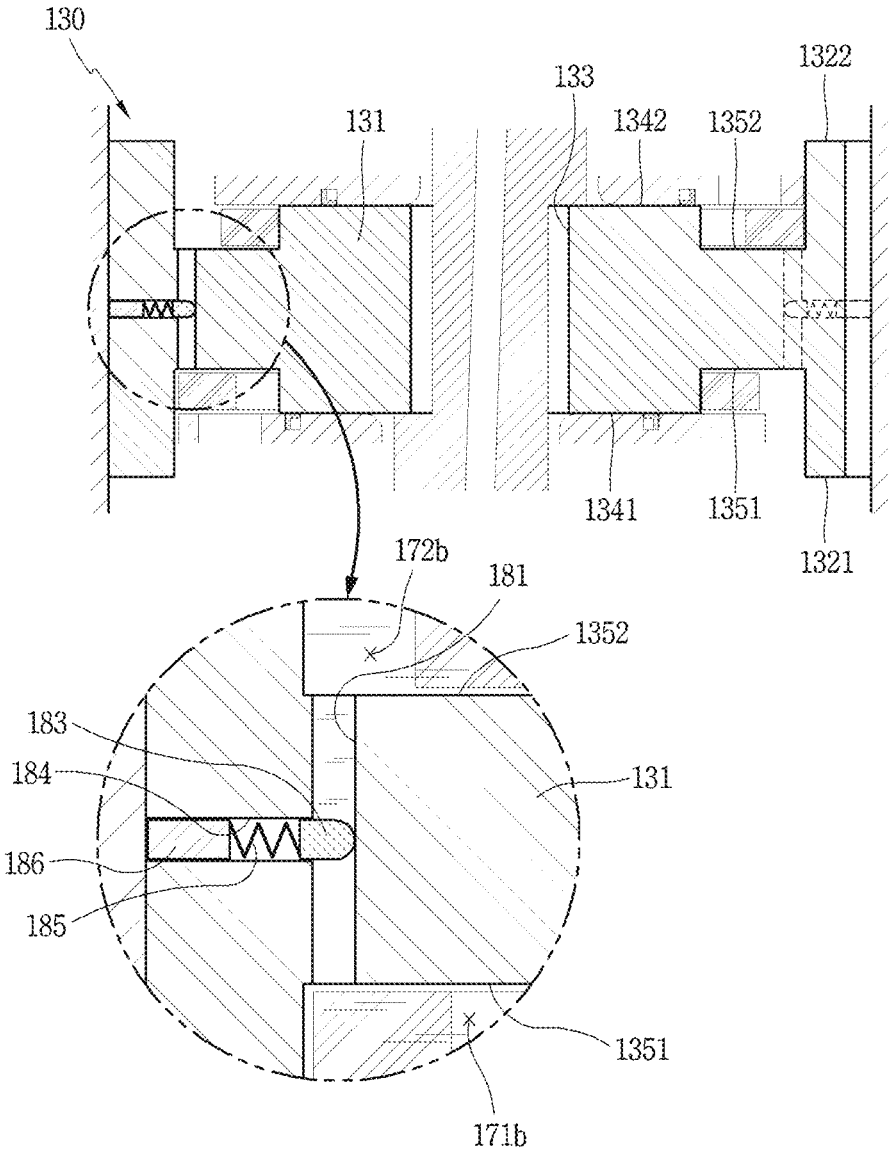
FIG. 12 is an assembled sectional view of FIG. 11.
Figure 13:
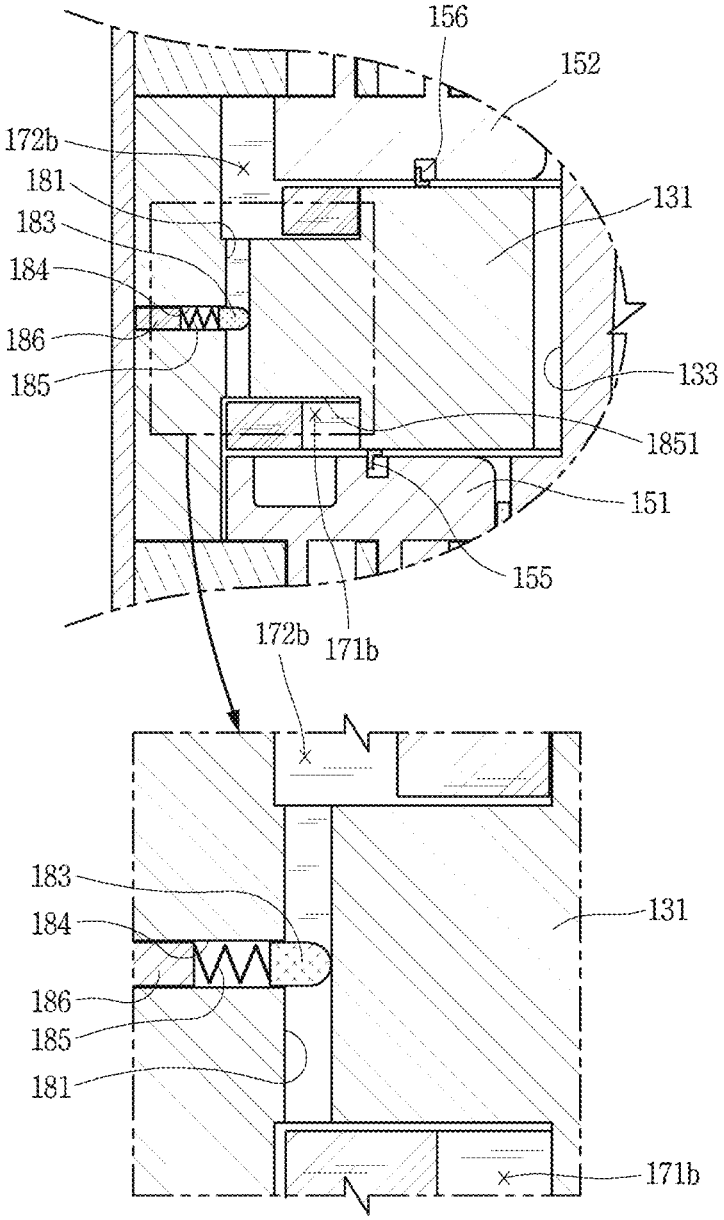
FIGS. 13 and 14 are sectional views illustrating a periphery of the back pressure communication unit according to an operation state of a compressor of FIG. 11.
Figure 14:
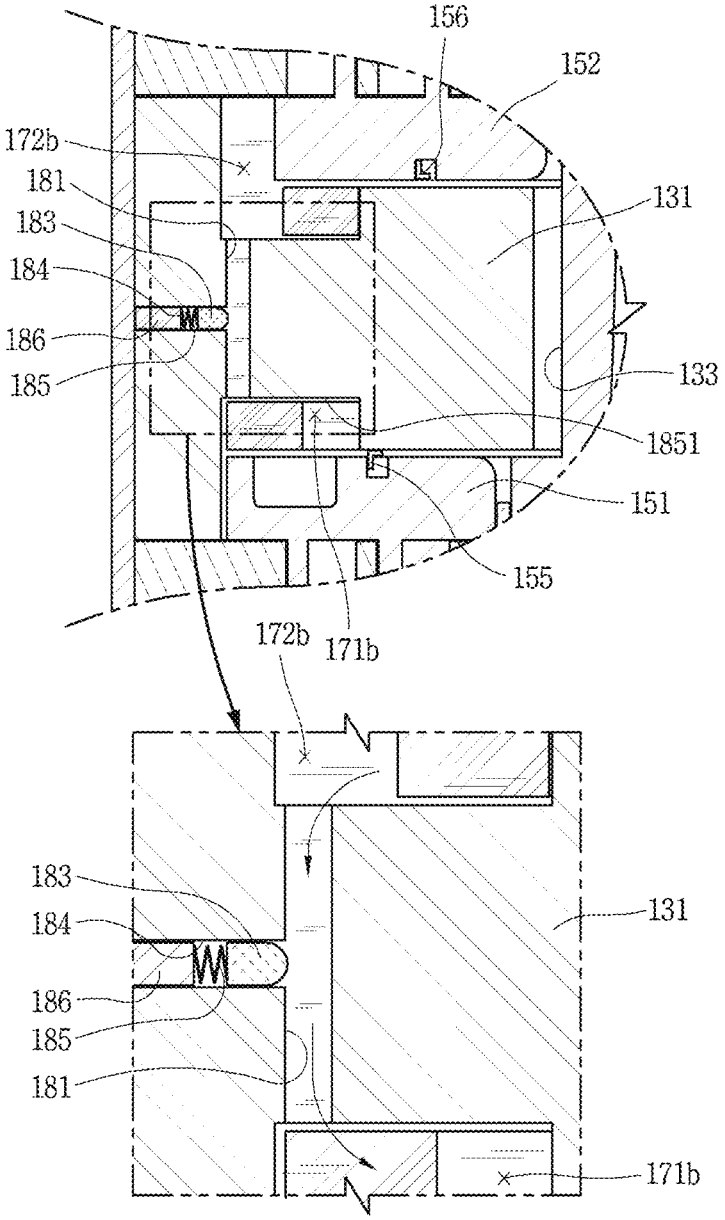

FIG. 11 is an exploded perspective view illustrating still another embodiment of the back pressure communication unit. FIG. 12 is an assembled sectional view of FIG. 11. FIGS. 13 and 14 are sectional views illustrating a periphery of the back pressure communication unit according to an operation state of a compressor of FIG. 11. FIG. 13 shows a state of a normal operation. FIG. 14 shows a state of an abnormal operation.

Referring to FIGS. 11 to 12, a basic configuration of the scroll compressor according to the present embodiment and an operating effect thereof are similar to those in the embodiments described above. For example, the first compression unit C1 and the second compression unit C2 may be separated from each other by the main frame 130, and the main frame 130 may be equipped with the back pressure communication unit 180 configured to communicate between the first back pressure chamber 171 of the first compression unit C1 and the second back pressure chamber 172 of the second compression unit C2. When a back pressure in the first back pressure chamber 171 and/or the second back pressure chamber 172 is increased excessively, the back pressure communication unit 180 may cause oil to be leaked into a back pressure chamber having a relatively low back pressure to properly maintain a back pressure in the corresponding back pressure chamber. A detailed description thereof is replaced by the description of the embodiments with respect to FIGS. 4, 7, and 8.

However, the back pressure communication unit 180 according to the present embodiment may include the back pressure communication hole 181 and a valve member 183.

For example, the back pressure communication hole 181 may be configured to have one inner diameter or a plurality of inner diameters as described above. However, since the back pressure communication hole 181 is opened or closed by the valve member 183, the back pressure communication hole 181 may be configured to have one inner diameter. In this case, even when the back pressure communication hole 181 is configured to be larger than that in the embodiment described with reference to FIG. 4, the back pressure communication hole 181 may be kept in a state blocked by the valve member 183 during a normal operation. Accordingly, an inner diameter of the back pressure communication hole 181 may be configured to have a great length and to be easily machined.

The valve member 183 may be configured as a ball valve or a piston valve. The valve member 183 may be configured to have a size equal to or larger than a sectional area of the back pressure communication hole 181. Accordingly, the back pressure communication hole 181 may be opened or closed by the valve member 183.

For example, the valve accommodating hole 184 may be disposed in the main frame 130, i.e., in the frame end plate 131 so that the valve member 183 slides into the valve accommodating hole 184. The valve accommodating hole 184 may have an inner diameter greater than an outer diameter of the valve member 183.

In addition, one end of the valve accommodating hole 184 may be opened toward an outer circumferential surface of the main frame 130, and another end of the valve accommodating hole 184 may be opened toward an inner circumferential surface of the back pressure communication hole 181. In other words, the valve accommodating hole 184 may be disposed to communicate with the back pressure communication hole 181 in a direction intersecting with the back pressure communication hole 181. The one end of the valve accommodating hole 184 may be covered using a separate cover member (not shown) after inserting an elastic member 185 to be described later.

Additionally, the elastic member 185 such as a compression coil spring may be equipped at a side opposite to the back pressure communication hole 181. Accordingly, the valve member 183 may be supported by the elastic member 185 in a direction toward the back pressure communication hole 181.

As described above, when one valve member 183 is disposed in the direction intersecting with the back pressure communication hole 181, as the valve member 183 moves forward or backward inside the valve accommodating hole 184 according a pressure of the first back pressure chamber 171 (precisely, the first outer back pressure chamber) and the second back pressure chamber 172 (precisely, the second outer back pressure chamber), the back pressure communication hole 181 may be opened or closed.

For example, as shown in FIG. 13, during a normal operation in which the first back pressure sealing member 155 and/or the second back pressure sealing member 156 are normally lifted, the first outer back pressure chamber 171*b* and the first inner back pressure chamber 171*a* and/or the second outer back pressure chamber 172*b* and the second inner back pressure chamber 172*a* are quickly separated from each other. Then, the first outer pressure chamber 171*b* and the second outer pressure chamber 172*b* each define an intermediate pressure smaller than elastic force of the elastic member 185. Then, the valve member 183 is pushed in a closing direction by the elastic member 185 to block the back pressure communication hole 181. Then, since the first compression unit C1 and the second compression unit C2 may receive an appropriate back pressure from the back pressure chambers 171 and 172, respectively, a friction loss or damage may not occur or may be minimized to thereby suppress leakage between the compression chambers. Accordingly, during a normal operation, the back pressure communication hole 181 may be mechanically blocked using one valve member 183. Thus, the back pressure communication hole 181 may be configured to have a large inner diameter, while oil in a back pressure chamber located at an upper side may be suppressed from being leaked into a back pressure chamber located at a lower side.

On the other hand, as shown in FIG. 14, during an abnormal operation in which lifting of the first back pressure sealing member 155 and/or the second back pressure sealing member 156 is delayed, the first outer back pressure chamber 171*b* and the first inner back pressure chamber 171*a*, and/or the second outer back pressure chamber 172*b* and the second inner back pressure chamber 172*a* communicate with each other. Then, the first outer pressure chamber 171*b* and the second outer pressure chamber 172*b* may each press the valve member 183 toward the elastic member 185 using pressing force of a discharge pressure greater than the elastic force of the elastic member 185. Then, the valve member 183 is pushed in an opening direction to switch the back pressure communication hole 181 to an open state. Then, among the first back pressure chamber 171 and the second back pressure chamber 172, oil in a back pressure chamber with a relatively high back pressure is leaked into a back pressure chamber with a relatively low back pressure, thereby relieving an excessive back pressure in the back pressure chamber with a relatively high back pressure. Then, since the first compression unit C1 and the second compression unit C2 receive an appropriate back pressure from each back pressure chamber, a friction loss or damage may not occur or may be minimized to thereby suppress leakage between the compression chambers. Accordingly, in a case of abnormal operation of the compressor, back pressures of both the back pressure chambers may be maintained appropriately using one valve.

The invention claimed is:

1. A scroll compressor, comprising:

a casing;

a rotating shaft comprising a first eccentric portion and a second eccentric portion spaced apart from each other in an axial direction;

a first compression unit having a first orbiting scroll coupled to the first eccentric portion of the rotating shaft to perform an orbiting motion, and a first fixed scroll engaged with the first orbiting scroll to define a first compression chamber;

a second compression unit having a second orbiting scroll coupled to the second eccentric portion of the rotating shaft to perform an orbiting motion, and a second fixed scroll engaged with the second orbiting scroll to define a second compression chamber;

a main frame having a shaft accommodation portion disposed therein such that the rotating shaft penetrates through the shaft accommodation portion, and located between the first compression unit and the second compression unit;

a first back pressure chamber disposed between the first orbiting scroll and a first side surface of the main frame to support the first orbiting scroll toward the first fixed scroll; and a second back pressure chamber disposed between the second orbiting scroll and a second side surface of the main frame to support the second orbiting scroll toward the second fixed scroll, wherein the main frame comprises at least one back pressure communication unit configured to communicate between the first back pressure chamber and the second back pressure chamber, and wherein the at least one back pressure communication unit is configured as a back pressure communicating hole having a plurality of inner diameters.

2. The scroll compressor of claim 1, wherein a first back pressure sealing member is disposed between the first orbiting scroll and the first side surface of the main frame, the first side surface facing the first orbiting scroll, and configured to divide the first back pressure chamber into a first inner back pressure chamber and a first outer back pressure chamber, wherein a second back pressure sealing member is disposed between the second orbiting scroll and the second side surface of the main frame, the second side surface facing the second orbiting scroll, and configured to divide the second back pressure chamber into a second inner back pressure chamber and a second outer back pressure chamber, and wherein the at least one back pressure communication unit penetrates between the first outer back pressure chamber and the second outer back pressure chamber.

3. The scroll compressor of claim 1, wherein a first Oldham ring accommodation portion into which a first Oldham ring is inserted is disposed on the first side surface of the main frame to have an annular shape, and a second Oldham ring accommodation portion into which a second Oldham ring is inserted is disposed on the second side surface of the main frame to have an annular shape, and wherein the at least one back pressure communication unit penetrates between the first Oldham ring accommodation portion and the second Oldham ring accommodation portion.

4. The scroll compressor of claim 1, wherein the back pressure communicating hole is configured as a plurality of communication holes having different inner diameters, and a communication hole with a great inner diameter, among the plurality of communication holes, is configured to have a length greater than a length of a communication hole with a small inner diameter.

5. The scroll compressor of claim 1, wherein the second back pressure chamber is positioned closer to a drive motor than the first back pressure chamber, and wherein the back pressure communicating hole is configured such that an end portion toward the second back pressure chamber has a second diameter smaller than a first diameter of an end portion toward the first back pressure chamber.

6. The scroll compressor of claim 1, wherein the first eccentric portion and the second eccentric portion are disposed such that a center of the first eccentric portion and a center of the second eccentric portion are configured to be positioned at different rotational angles in an axial direction.

7. A scroll compressor, comprising:

a casing;

a rotating shaft comprising a first eccentric portion and a second eccentric portion spaced apart from each other in an axial direction;

a first compression unit having a first orbiting scroll coupled to the first eccentric portion of the rotating shaft to perform an orbiting motion, and a first fixed scroll engaged with the first orbiting scroll to define a first compression chamber;

a second compression unit having a second orbiting scroll coupled to the second eccentric portion of the rotating shaft to perform an orbiting motion, and a second fixed scroll engaged with the second orbiting scroll to define a second compression chamber;

a main frame having a shaft accommodation portion disposed therein such that the rotating shaft penetrates through the shaft accommodation portion, and located between the first compression unit and the second compression unit;

a first back pressure chamber disposed between the first orbiting scroll and a first side surface of the main frame to support the first orbiting scroll toward the first fixed scroll; and a second back pressure chamber disposed between the second orbiting scroll and a second side surface of the main frame to support the second orbiting scroll toward the second fixed scroll, wherein the main frame comprises at least one back pressure communication unit configured to communicate between the first back pressure chamber and the second back pressure chamber, wherein the at least one back pressure communication unit comprises a back pressure communication hole configured to communicate between the first back pressure chamber and the second back pressure chamber, and a pin member inserted into the back pressure communication hole, and wherein a sectional area of the pin member is disposed to be smaller than a sectional area of the back pressure communication hole.

8. The scroll compressor of claim 7, wherein a support end configured to support the pin member in an axial direction is disposed at one end of the back pressure communication hole.

9. The scroll compressor of claim 7, wherein a communication groove is disposed in an outer circumferential surface of the pin member, and wherein the communication groove is disposed to traverse between both longitudinal ends of the pin member.

10. The scroll compressor of claim 7, wherein a first Oldham ring accommodation portion into which a first Oldham ring is inserted is disposed on the first side surface of the main frame to have an annular shape, and a second Oldham ring accommodation portion into which a second Oldham ring is inserted is disposed on the second side surface of the main frame to have an annular shape, and wherein the at least one back pressure communication unit penetrates between the first Oldham ring accommodation portion and the second Oldham ring accommodation portion.

11. The scroll compressor of claim 7, wherein the first eccentric portion and the second eccentric portion are disposed such that a center of the first eccentric portion and a center of the second eccentric portion are configured to be positioned at different rotational angles in an axial direction.

12. The scroll compressor of claim 7, wherein a first back pressure sealing member is disposed between the first orbiting scroll and the first side surface of the main frame, the first side surface facing the first orbiting scroll, and configured to divide the first back pressure chamber into a first inner back pressure chamber and a first outer back pressure chamber, wherein a second back pressure sealing member is disposed between the second orbiting scroll and the second side surface of the main frame, the second side surface facing the second orbiting scroll, and configured to divide the second back pressure chamber into a second inner back pressure chamber and a second outer back pressure chamber, and wherein the at least one back pressure communication unit penetrates between the first outer back pressure chamber and the second outer back pressure chamber.

13. A scroll compressor, comprising:

a casing;

a rotating shaft comprising a first eccentric portion and a second eccentric portion spaced apart from each other in an axial direction;

a first compression unit having a first orbiting scroll coupled to the first eccentric portion of the rotating shaft to perform an orbiting motion, and a first fixed scroll engaged with the first orbiting scroll to define a first compression chamber;

a second compression unit having a second orbiting scroll coupled to the second eccentric portion of the rotating shaft to perform an orbiting motion, and a second fixed scroll engaged with the second orbiting scroll to define a second compression chamber;

a main frame having a shaft accommodation portion disposed therein such that the rotating shaft penetrates through the shaft accommodation portion, and located between the first compression unit and the second compression unit;

a first back pressure chamber disposed between the first orbiting scroll and a first side surface of the main frame to support the first orbiting scroll toward the first fixed scroll; and a second back pressure chamber disposed between the second orbiting scroll and a second side surface of the main frame to support the second orbiting scroll toward the second fixed scroll, wherein the main frame comprises at least one back pressure communication unit configured to communicate between the first back pressure chamber and the second back pressure chamber, wherein the at least one back pressure communication unit comprises a back pressure communication hole configured to communicate between the first back pressure chamber and the second back pressure chamber, and a valve member configured to open or close the back pressure communication hole, wherein a valve accommodating hole is further disposed in the main frame in a direction intersecting with the back pressure communication hole, and wherein the valve member is slidably inserted into the valve accommodating hole to open or close the back pressure communication hole.

14. The scroll compressor of claim 13, wherein the valve member is supported in a direction toward the back pressure communication hole by an elastic member disposed at a side opposite to the back pressure communication hole.

15. The scroll compressor of claim 13, wherein a first back pressure sealing member is disposed between the first orbiting scroll and the first side surface of the main frame, the first side surface facing the first orbiting scroll, and configured to divide the first back pressure chamber into a first inner back pressure chamber and a first outer back pressure chamber, wherein a second back pressure sealing member is disposed between the second orbiting scroll and the second side surface of the main frame, the second side surface facing the second orbiting scroll, and configured to divide the second back pressure chamber into a second inner back pressure chamber and a second outer back pressure chamber, and wherein the at least one back pressure communication unit penetrates between the first outer back pressure chamber and the second outer back pressure chamber.

16. The scroll compressor of claim 13, wherein a first Oldham ring accommodation portion into which a first Oldham ring is inserted is disposed on the first side surface of the main frame to have an annular shape, and a second Oldham ring accommodation portion into which a second Oldham ring is inserted is disposed on the second side surface of the main frame to have an annular shape, and wherein the at least one back pressure communication unit penetrates between the first Oldham ring accommodation portion and the second Oldham ring accommodation portion.

17. The scroll compressor of claim 13, wherein the first eccentric portion and the second eccentric portion are disposed such that a center of the first eccentric portion and a center of the second eccentric portion are configured to be positioned at different rotational angles in an axial direction.

* * * * *